US010502212B2

(12) United States Patent
Lee et al.

(10) Patent No.: US 10,502,212 B2
(45) Date of Patent: Dec. 10, 2019

(54) MOTOR-OPERATED COMPRESSOR

(71) Applicant: LG ELECTRONICS INC., Seoul (KR)

(72) Inventors: Junggu Lee, Seoul (KR); Taekyoung Kim, Seoul (KR); Yicheol Choi, Seoul (KR); Joohyung Kim, Seoul (KR); Ilyoung Park, Seoul (KR); Bumsuk Kim, Seoul (KR); Junyoung Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 235 days.

(21) Appl. No.: 15/363,287

(22) Filed: Nov. 29, 2016

(65) Prior Publication Data

US 2017/0292517 A1 Oct. 12, 2017

Related U.S. Application Data

(60) Provisional application No. 62/319,263, filed on Apr. 6, 2016.

(30) Foreign Application Priority Data

Jun. 9, 2016 (KR) ..... 10-2016-0071897
Jun. 9, 2016 (KR) ..... 10-2016-0071898
Jun. 9, 2016 (KR) ..... 10-2016-0071899

(51) Int. Cl.
*F04C 29/02* (2006.01)
*F04C 29/04* (2006.01)
(Continued)

(52) U.S. Cl.
CPC ..... *F04C 29/047* (2013.01); *F04C 18/0215* (2013.01); *F04C 27/005* (2013.01);
(Continued)

(58) Field of Classification Search
CPC ..... F04C 29/047; F04C 2240/808; F04C 2240/403; F04C 29/0085; F04C 29/12;
(Continued)

(56) References Cited

U.S. PATENT DOCUMENTS 5,377,798 A * 1/1995 Hudson ..... F16D 35/023 192/58.4
5,597,035 A * 1/1997 Smith ..... G06F 1/20 165/147
(Continued)

FOREIGN PATENT DOCUMENTS

CN 1840909 A 10/2006
CN 105756927 A 7/2016
(Continued)

*Primary Examiner* — Peter J Bertheaud
*Assistant Examiner* — Dnyanesh G Kasture
(74) *Attorney, Agent, or Firm* — Birch, Stewart, Kolasch & Birch, LLP

(57) ABSTRACT

A motor-operated compressor includes a casing having an inner space in which a driving motor, an orbiting scroll and a fixed scroll are accommodated, and a controller provided outside the casing. The casing includes an intake hole formed at a side adjacent to the controller and an exhaust hole formed at a side adjacent to the fixed scroll on the basis of the driving motor. The casing includes a communication passage formed between the casing and a stator of the driving motor, such that a refrigerant introduced into the inner space through the intake hole is introduced into the suction chamber through the driving motor. A back pressure space supporting the orbiting scroll is sealed by oil. The stator has teeth on its inner circumferential surface and protrusions on its outer circumferential surface, each protrusion being located within a width range of each tooth.

18 Claims, 14 Drawing Sheets

(51) Int. Cl.

| | |
|---|---|
| ***F04C 18/02*** | (2006.01) |
| ***F04C 29/00*** | (2006.01) |
| ***F04C 29/12*** | (2006.01) |
| ***F04C 27/00*** | (2006.01) |

(52) U.S. Cl.
CPC ..... *F04C 29/0085* (2013.01); *F04C 29/12* (2013.01); *F04C 29/028* (2013.01); *F04C 2240/30* (2013.01); *F04C 2240/40* (2013.01); *F04C 2240/50* (2013.01); *F04C 2240/60* (2013.01); *F04C 2240/807* (2013.01); *F04C 2240/808* (2013.01)

(58) Field of Classification Search
CPC ..... F04C 27/005; F04C 2240/807; F04C 2240/50; F04C 29/028; F04C 2240/30; F04C 2240/40; F04C 2240/60; F04C 18/0215; F04C 29/02; H02K 5/20
See application file for complete search history.

(56) References Cited

U.S. PATENT DOCUMENTS

| | | | | |
|---|---|---|---|---|
| 6,607,942 | B1 * | 8/2003 | Tsao | H01L 23/3128 257/707 |
| 8,035,271 | B2 * | 10/2011 | Sano | H02K 1/185 310/216.049 |
| 9,628,004 | B2 * | 4/2017 | Sakai | H02M 7/5395 |
| 2003/0206815 | A1 * | 11/2003 | Iritani | F04B 35/04 417/366 |
| 2004/0109772 | A1 | 6/2004 | Ogawa et al. | |
| 2004/0124731 | A1 * | 7/2004 | Kimura | F04C 23/008 310/216.044 |
| 2005/0100448 | A1 * | 5/2005 | Graf | F02M 39/005 417/273 |
| 2005/0201873 | A1 * | 9/2005 | Ogawa | F04B 35/04 417/366 |
| 2006/0153725 | A1 * | 7/2006 | Koide | F04C 18/0215 418/55.6 |
| 2010/0092321 | A1 | 4/2010 | Kim et al. | |
| 2011/0142695 | A1 * | 6/2011 | Taguchi | F04B 39/14 417/410.1 |
| 2013/0043758 | A1 | 2/2013 | Elson et al. | |
| 2013/0089451 | A1 | 4/2013 | Ahn et al. | |
| 2013/0209305 | A1 * | 8/2013 | Takei | F04C 18/0215 418/55.3 |
| 2013/0259726 | A1 * | 10/2013 | Yamashita | F04C 18/0215 418/55.1 |
| 2014/0003974 | A1 | 1/2014 | Fukasaku et al. | |
| 2014/0199199 | A1 * | 7/2014 | Meinig | F04C 18/34 418/91 |
| 2014/0348680 | A1 * | 11/2014 | Lee | F04C 18/0261 418/55.2 |
| 2015/0010417 | A1 * | 1/2015 | Won | F04C 18/0215 418/55.5 |
| 2016/0333880 | A1 * | 11/2016 | Onara | F04C 29/0085 |

FOREIGN PATENT DOCUMENTS

| | | | |
|---|---|---|---|
| JP | 2012-2152 | A | 1/2012 |
| JP | 2014-101823 | A | 6/2014 |
| KR | 10-2014-0038088 | A | 3/2014 |
| KR | 10-2015-0051534 | A | 5/2015 |
| KR | 10-2015-0051537 | A | 5/2015 |
| KR | 10-2015-0051538 | A | 5/2015 |
| KR | 10-2016-0074301 | A | 6/2016 |

* cited by examiner

MOTOR-OPERATED COMPRESSOR

CROSS-REFERENCE TO RELATED APPLICATION

Pursuant to 35 U.S.C. § 119, this application claims the benefit of an earlier filing date of and the right of priority to U.S. application Ser. No. 62/319,263, filed on Apr. 6, 2016, and Korean Applications No. 10-2016-0071897, No. 10-2016-0071898, and No. 10-2016-0071899, all filed on Jun. 9, 2016, the contents of which are incorporated by reference herein in their entireties.

BACKGROUND OF THE INVENTION

1. Field of the Invention

This specification relates to a compressor, and more particularly, a motor-operated compressor applied to a vehicle.

2. Background of the Invention

In general, a compressor which serves to compress a refrigerant in an air-conditioning system for a vehicle has been developed into various forms. Recently, a motor-operated compressor which is driven by electric power using a motor is actively developed, keeping pace with vehicle electrification.

The motor-operated compressor generally employs a scroll compression method, which is appropriate for an operation with a high compression ratio among various compression methods. In the scroll type motor-operated compressor, a motor unit with a rotary motor is installed within a hermetic case, and a compression unit with a fixed scroll and an orbiting scroll is installed at one side of the motor unit. The motor unit and the compression unit are connected to each other by a rotation shaft and accordingly a rotational force of the motor unit is transferred to the compression unit. The rotational force transferred to the compression unit allows the orbiting scroll to perform an orbiting motion with respect to the fixed scroll, so as to form a pair of compression chambers each having a suction chamber, an intermediate pressure chamber and a discharge chamber. Accordingly, a refrigerant is introduced into each of the compression chambers, compressed and then simultaneously discharged out of each of the compression chambers.

The motor of the motor-operated compressor operates at a constant speed, but in recent time, an inverter type compressor with a motor which is capable of operating at variable operating speeds is widely introduced to meet various demands of consumers. In the inverter type motor-operated compressor, an inverter is typically mounted on an outer circumferential surface of a casing and electrically connected to a motor within the casing using a terminal which is inserted through the casing.

However, since the motor-operated compressor employs the operating method using electric power, the motor and the inverter constructing the compressor generate heat, which greatly affects performances of the motor and the inverter. Therefore, many methods for solving the problem of the heat generation are proposed. Among others, a method of cooling the motor and the inverter using a refrigerant introduced into the casing of the motor-operated compressor is generally known.

This method is configured in a manner that a refrigerant introduced into the casing through an inlet port directly cools the motor while flowing between a stator and a rotor or between the stator and an inner circumferential surface of the casing, and simultaneously indirectly cools the inverter mounted to an outside of the casing through the casing.

However, the inverter generates very high heat depending on devices. In spite of this, the inverter is indirectly cooled by the refrigerant introduced into the casing, which lowers cooling efficiency with respect to the inverter.

Also, a flow rate may increase to enhance such cooling efficiency. However, this decreases a refrigerant passage area of a portion adjacent to the inverter, which causes an increase in suction resistance with respect to the refrigerant. This results in a suction loss of the compressor.

Meanwhile, in addition to regulations set on the use of CFCs and HCFCs used as a refrigerant, the regulation on the use of HFCs as the refrigerant has also been more tightened recently, and thus an interest in an eco-friendly natural refrigerant is increasing. Hydrocarbon, ammonia, water, air, carbon dioxide and the like are well known as such natural refrigerant. Among others, the carbon dioxide ($CO_2$) is considered to be useful in the aspects of a size reduction, high efficiency, high pressure and low costs.

However, a motor-operated compressor using $CO_2$ refrigerant generates internal pressure which is approximately 8 times higher than pressure generated when using the conventional R134a refrigerant, which may cause a casing to be elastically deformed like being inflated during an operation of the compressor. As a surface of the casing is deformed like a curved surface accordingly, a contact area with a switching element IGBT attached to the casing is reduced, and thereby an adhesive force of the switching element is weakened. This is likely to cause the separation of the switching element due to vibration of the compressor.

Also, as the contact area between the switching element and the casing is reduced due to the elastic deformation of the casing, a heat dissipation effect with respect to the switching element is likely to be lowered. Considering this, in the related art, a heat transfer member such as a thermal pad is additionally interposed between the casing and the switching element. This makes an assembly process complicated and results in an increase in fabricating costs. This also makes it difficult to use a separate coupling member, such as a screw, taking into account a detachment of the switching element.

Meanwhile, as the internal pressure of the casing increases due to the use of the $CO_2$ refrigerant, reliability of the compressor can be maintained only by firmly fixing a terminal connecting a motor and an external power source. Considering this, the terminal may be fixed to the casing in a welding manner. However, to improve a welding effect between the terminal and the casing, all or part of the casing welded with the terminal is made of an iron (Fe)-based metal, which is a material used for forming the terminal, which causes an increase in an entire weight of the compressor. This also brings about an increase in a weight of a vehicle when the compressor is installed in the vehicle, specifically, an electric vehicle.

Also, in case where the terminal is welded on the casing, when the casing has to be replaced due to being deformed or damaged, the terminal should also be replaced together with the casing. Material costs and maintenance costs are increased accordingly.

Meanwhile, in the related art motor-operated compressor, a stator is press-fitted in an inner circumferential surface of the casing. However, the stator is formed by laminating a plurality of thin iron plates and a plurality of slots for winding a coil are formed on an inner circumferential surface of the stator. Accordingly, when the stator is press-fitted into the casing, the slots get farther away from one another and thereby friction or noise is generated between the stator and a rotor, which is likely to lower reliability of the compressor.

As the stator is press-fitted into the casing, stress is concentrated on both ends of the stator in an axial direction. Accordingly, the stator is deformed and thereby friction and noise are caused, resulting in lowered reliability of the compressor.

Meanwhile, the related art motor-operated compressor is provided with a back pressure space at a rear surface of an orbiting scroll. When the $CO_2$ refrigerant is used, pressure of the back pressure space additionally increases. Therefore, a high sealing force is required for the back pressure space. However, when the sealing force increases, a frictional loss against a rotation shaft is likely to increase, which possibly results in lowering performance of the compressor. Therefore, a solution for increasing the sealing force and lowering the frictional loss against the rotation shaft is needed.

SUMMARY OF THE INVENTION

Therefore, an aspect of the detailed description is to provide a motor-operated compressor, capable of effectively cooling an inverter and a motor using a refrigerant introduced into a casing.

Another aspect of the detailed description is to provide a motor-operated compressor, in which a refrigerant sucked into the casing is sucked toward an inverter and then introduced into a compression unit after flowing through a motor.

Another aspect of the detailed description is to provide a motor-operated compressor which is suitable for applying an eco-friendly refrigerant, such as $CO_2$ refrigerant.

Another aspect of the detailed description is to provide a motor-operated compressor, capable of stably maintaining an adhered state of an element which constructs an inverter even though a casing is inflated upon applying a high pressure refrigerant.

Another aspect of the detailed description is to provide a motor-operated compressor capable of facilitating an assembly of a terminal.

Another aspect of the detailed description is to provide a motor-operated compressor capable of forming a casing with a different material from a material of a terminal.

Another aspect of the detailed description is to provide a motor-operated compressor, capable of reducing a weight of the compressor by forming a part of a casing using a material lighter than iron.

Another aspect of the detailed description is to provide a motor-operated compressor capable of reducing stress concentrated on a stator when the stator is press-fitted into a casing.

Another aspect of the detailed description is to provide a motor-operated compressor capable of preventing slots of a stator from being more spaced apart from one another due to press-fitting of the stator.

Another aspect of the detailed description is to provide a motor-operated compressor capable of simplifying a sealing portion forming a back pressure space.

Another aspect of the detailed description is to provide a motor-operated compressor capable of reducing a frictional loss at a sealing portion forming a back pressure space while applying $CO_2$ refrigerant.

Another aspect of the detailed description is to provide a motor-operated compressor capable of fast forming a back pressure space.

To achieve these and other advantages and in accordance with the purpose of this specification, as embodied and broadly described herein, there is provided a motor-operated compressor, including a driving motor provided with a stator with a coil wound thereon, and a rotor rotatably disposed in the stator, a rotation shaft coupled to the rotor and transferring a rotation force of the driving motor, an orbiting scroll coupled to the rotation shaft and performing an orbiting motion, a fixed scroll engaged with the orbiting scroll to form compression chambers together with the orbiting scroll, the compression chambers each having a suction chamber, an intermediate pressure chamber and a discharge chamber, a frame provided at an opposite side of the fixed scroll with interposing the orbiting scroll therebetween, and supporting the orbiting scroll, a control unit provided at an opposite side of the frame with interposing the driving motor therebetween, and a casing accommodating the driving motor, the orbiting scroll and the fixed scroll in an inner space thereof, and provided with an intake hole formed at a side adjacent to the control unit and an exhaust hole formed at a side adjacent to the fixed scroll on the basis of the driving motor, the casing comprising a communication passage formed between the casing and the stator, such that a refrigerant introduced into the inner space through the intake hole is introduced into the suction chamber through the driving motor.

Here, the casing may include a housing coupled with the stator of the driving motor, and a cover may be coupled to one end having the intake hole, of both ends of the housing, to seal the inner space of the casing. A plurality of devices such as switching elements may be coupled to an outer side surface of the cover, and slits or grooves each with predetermined depth and width may be formed along circumferences of the devices, respectively, on the outer side surface of the cover coupled with the devices. The slits may surround outer circumferences of the devices, respectively. With the configuration, upon applying a high pressure refrigerant such as $CO_2$ refrigerant, a surface of the casing with the devices attached can be prevented from being deformed into a curved surface although internal pressure of the casing increases. This may result in enhancing a coupling force or a heat dissipation effect of the devices.

The cover may be made of a material lighter than a material forming the housing. This may reduce a weight of the compressor, which can be effective when the compressor is applied to an electric vehicle.

Heat sink fins or heat sink recesses may be formed on an inner side surface of the cover to allow for heat exchange with a refrigerant introduced through the intake port, or a chamber portion with a predetermined volume may be formed on an inner side surface of the cover. An inlet of the chamber portion may communicate with the intake hole, and an outlet thereof may communicate with the inner space of the casing. With the configuration, the heat dissipation effect of the devices can be more enhanced.

The cover may be provided with a terminal mounting hole for coupling a terminal, and at least one end of the terminal inserted into the terminal mounting hole may be coupled using a fixing member. With the configuration, a fixing operation of the terminal can be facilitated and the cover can be made of a light material, thereby reducing the weight of the compressor.

A flange having an outer diameter greater than an inner diameter of the terminal mounting hole may be formed on one end of the terminal, and a male thread may be formed on another end opposite to the end with the flange. The male thread may be inserted through the terminal mounting hole and coupled to a female thread of the fixing member at an outer side of the casing, in a state that the flange is locked by the inner side surface of the casing at a periphery of the terminal mounting hole.

A sealing member may be provided between the flange and one side surface of the casing corresponding to the flange or between the fixing member and another side surface of the casing corresponding to the fixing member. With the configuration, a leakage of a refrigerant to a coupled portion of the terminal can be prevented even though internal pressure increases upon applying $CO_2$ refrigerant.

A plurality of teeth each with a coil wound thereon may be provided on an inner circumferential surface of the stator with interposing slots along a circumferential direction, and a plurality of protrusions each with a predetermined height to be contactable with an inner circumferential surface of the casing may be formed on an outer circumferential surface of the stator with interposing recesses along a circumferential direction. At least part of each of the protrusions may be located within a range in a radial direction of each of the teeth. With the configuration, the slots can be prevented from opening wide from each other due to stress applied from the casing and concentrated on the stator.

Each of the protrusions may be located within an arcuate length range of each of the teeth.

An arcuate length of each of the protrusions may be smaller than or equal to an arcuate length of each of the teeth.

A stress reducing portion may be formed on an inner circumferential surface of the casing with being spaced apart from an outer circumferential surface of the stator, and the stress reducing portion may be provided by at least one within a range in an axial direction of the stator.

The stress reducing portion may be formed at a position where an end portion of the stator in the axial direction is accommodated.

Here, the frame may be provided with a shaft hole formed therethrough, the rotation shaft being inserted into the shaft hole such that an outer circumferential surface of the rotation shaft faces an inner circumferential surface of the shaft hole. One side of the shaft hole may be open toward a rear surface of the orbiting scroll so as to form a back pressure space together with the rear surface of the orbiting scroll, and a gap between the inner circumferential surface of the shaft hole and the outer circumferential surface of the rotation shaft may be sealed by oil introduced into the back pressure chamber. With the configuration, when applying a high pressure refrigerant such as $CO_2$ refrigerant, even though pressure of the back pressure space increases, a frictional loss which is caused due to an excessive contact between a sealing portion and the rotation shaft can be reduced.

Each of the fixed scroll and the frame may be provided with at least one back pressure hole through which refrigerant and oil discharged from the compression chambers are introduced into the back pressure chamber. An entire sectional area of the back pressure hole may be greater than or equal to an entire sectional area of a gap generated between the inner circumferential surface of the shaft hole and the outer circumferential surface of the rotation shaft. This may allow the back pressure space to be always filled with an appropriate amount of oil.

The back pressure space may be provided with a balance weight coupled to the rotation shaft to be rotatable together with the rotation shaft, and a height of the back pressure hole may be equal to or lower than a middle height of the balance weight in a perpendicular direction to an axial direction of the driving motor.

A reverence seal may be formed on at least one of the inner circumferential surface of the shaft hole and the outer circumferential surface of the rotation shaft corresponding to the inner circumferential surface of the shaft hole. This may result in improving a sealing force of the back pressure space.

An oil pocket may be formed on at least one of the inner circumferential surface of the shaft hole and the outer circumferential surface of the rotation shaft corresponding to the inner circumferential surface of the shaft hole.

The frame may be provided with an oil supply hole communicating with the oil pocket.

To achieve the aspects and other features of the present invention, there is provided with a motor-operated compressor, including a motor unit having a stator with a coil wound thereon, and a rotor rotatably provided in the stator, a rotation shaft to transfer a rotation force of the motor unit, a compression unit coupled to the rotation shaft to compress a refrigerant by receiving the rotation force of the motor unit, a frame provided between the motor unit and the compression unit to support the rotation shaft, a control unit provided at an opposite side of the frame with interposing the driving motor therebetween, and a casing accommodating the driving motor, the orbiting scroll and the fixed scroll in an inner space thereof, located outside the control unit, and provided with an intake hole formed at a side adjacent to the control unit and an exhaust hole formed at a side adjacent to the fixed scroll on the basis of the driving motor, the casing comprising a communication passage formed between the casing and the stator, such that a refrigerant introduced into the inner space through the intake hole is introduced into the suction chamber through the driving motor, wherein the casing is provided with devices attached to an outer surface thereof at a side having the intake hole on the basis of the driving motor, and slits formed along circumferences of the devices, respectively.

Here, heat sink fins or heat sink recesses may be formed on an inner side surface of the casing with the devices attached thereto.

To achieve the aspects and other features of the present invention, there is provided with a motor-operated compressor, including a casing, a compression unit provided within the casing to suck, compress and discharge a refrigerant, a rotation shaft to transfer a driving force to the compression unit, a rotor coupled to the rotation shaft to transfer the driving force to the rotation shaft, and a stator disposed at an outer side of the rotor, formed by laminating a plurality of stator cores each formed in a ring shape and press-fitted into an inner circumferential surface of the casing, the stator comprising a plurality of teeth formed on an inner circumferential surface thereof in a circumferential direction with interposing slots, and each having a coil wound thereon, and a plurality of protrusions formed on an outer circumferential surface thereof in a circumferential direction and contactable with an inner circumferential surface of the casing, at least part of each of the protrusions being located within an arcuate length range of each of the teeth.

A stress reducing portion may be formed on the inner circumferential surface of the casing with being spaced apart from the outer circumferential surface of the stator. The stress reducing portion may be provided by at least one within a range of the stator in an axial direction of the stator.

To achieve the aspects and other features of the present invention, there is provided with a motor-operated compressor, including a casing, a stator fixed to the casing, a rotor rotatably disposed within the stator, a rotation shaft coupled to the rotor and rotatable along with the rotor, an orbiting scroll coupled to the rotation shaft and performing an orbiting motion, a fixed scroll engaged with the orbiting scroll and forming compression chambers together with the orbiting scroll, the compression chambers each having a suction chamber, an intermediate pressure chamber and a discharge chamber, and a frame provided at an opposite side of the fixed scroll with the orbiting scroll interposed therebetween to support the orbiting scroll, and provided with a shaft hole formed therethrough, the rotation shaft being inserted into the shaft hole such that an outer circumferential surface of the rotation shaft faces an inner circumferential surface of the shaft hole, wherein one side of the shaft hole is open toward a rear surface of the orbiting scroll so as to form a back pressure space together with the rear surface of the orbiting scroll, and wherein a gap between the inner circumferential surface of the shaft hole and the outer circumferential surface of the rotation shaft is sealed by oil introduced into the back pressure chamber.

Here, the frame may be provided with an oil supply hole communicating with an inner side surface of the back pressure space. A sectional area of the back pressure hole may be greater than or equal to an entire sectional area of a gap between an inner circumferential surface of the shaft hole and an outer circumferential surface of the rotation shaft corresponding to the inner circumferential surface of the shaft hole.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of a motor-operated compressor according to exemplary embodiments disclosed herein, with reference to the accompanying drawings.

Figure 1:
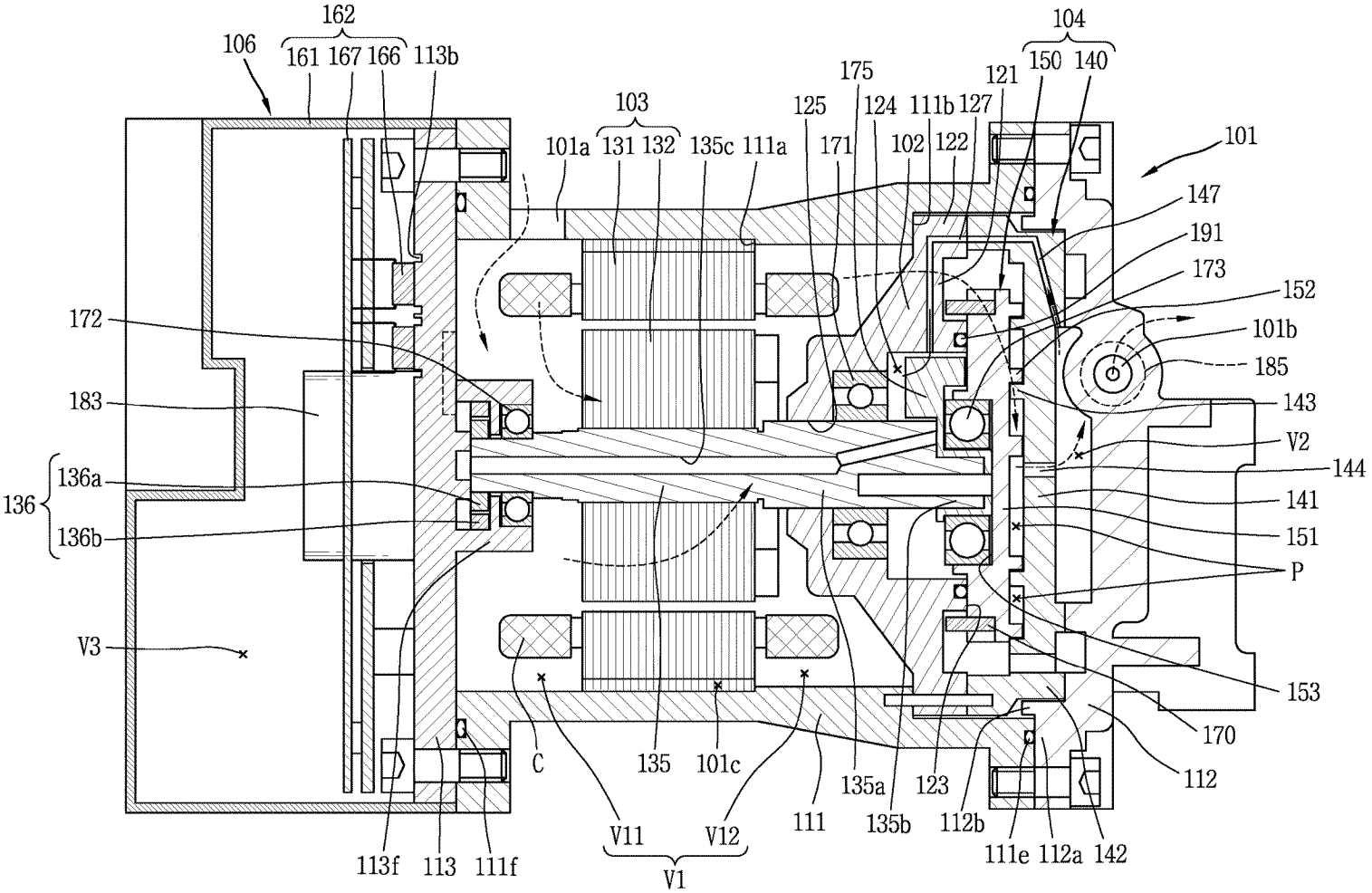
FIG. 1 is a longitudinal sectional view illustrating an inside of a scroll compressor as one example of a motor-operated compressor according to the present invention.
Figure 2:
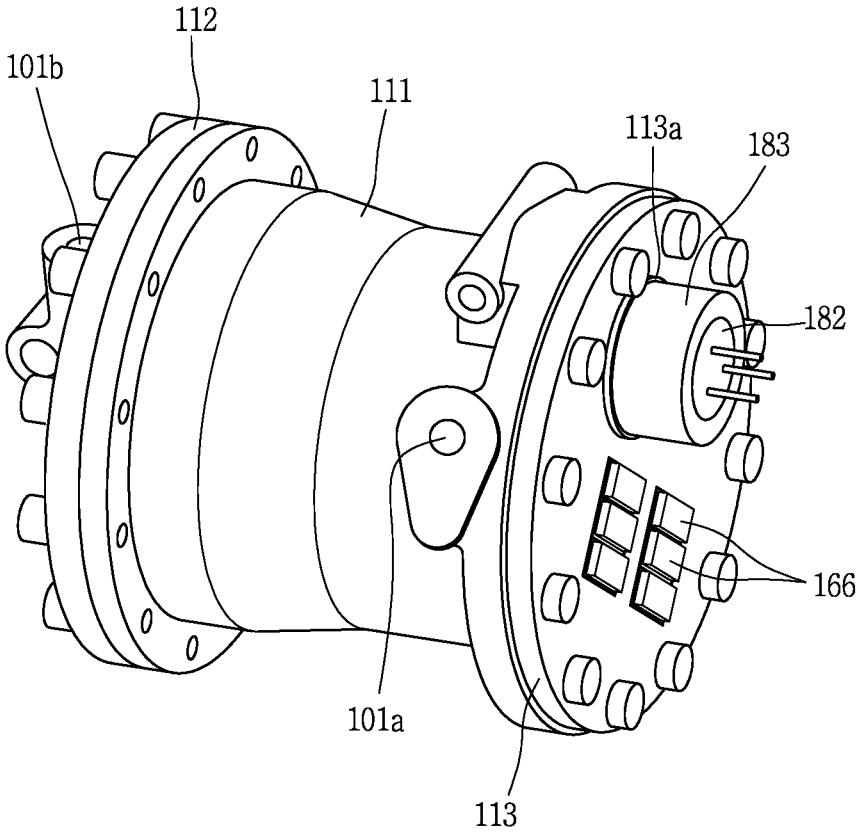
FIG. 2 is a perspective view illustrating appearance of a casing of the scroll compressor according to FIG. 1.

FIG. 1 is a longitudinal sectional view illustrating an inside of a scroll compressor as one example of a motor-operated compressor according to the present invention, and FIG. 2 is a perspective view illustrating appearance of a casing of the scroll compressor according to FIG. 1.

As illustrated in FIGS. 1 and 2, a scroll compressor according to this embodiment may include a casing 101, a frame 102 fixedly-installed in a middle of a casing 101, a driving motor 103 disposed at one side of the frame 102 to generate a driving force, and a compression unit 104 disposed at another side of the frame 102 to compress a refrigerant by receiving the driving force from the driving motor 103. A control unit or controller (hereinafter, referred to as an inverter) 106 which controls an operation of the compressor may be installed on an outside of the casing 101. The inverter 106 may be located at an opposite side to the compression unit based on the driving motor 103.

The compression unit 104 may include a fixed scroll 140 and an orbiting scroll 150. The orbiting scroll 150 is eccentrically coupled to a rotation shaft 135, which is coupled to a rotor 132 of the driving motor 103, and thus performs an orbiting motion with respect to the fixed scroll 140 so as to form a pair of compression chambers P together with the fixed scroll 140. Each of the pair of compression chambers P includes a suction chamber, an intermediate pressure chamber and a discharge chamber.

As illustrated in FIGS. 1 and 2, the casing 101 may include a housing 111 formed in a cylindrical shape with both end open and forming a suction space V1, a rear cover 112 coupled to cover a rear side of the housing 111 and forming a discharge space V2 together with a rear surface of the fixed scroll 140, and a front cover 113 coupled to cover a front side of the housing 111 and forming an inverter space V3 together with an inverter cover 161 to be explained later.

Here, the suction space V1 is divided into a first space V11 and a second space V12 by the driving motor 103. The first space V11 and the second space V12 may communicate with each other through a plurality of communication passages 101*c* which are formed between an outer circumferential surface of a stator 131 of the driving motor 103 and an inner circumferential surface of the housing 111. The first space V11 is formed by the housing 111 together with the front cover 113, and the second space V12 is formed by the housing 111 together with the frame 102. Accordingly, a refrigerant is introduced into the first space V11 located at a side of the front cover 113 and then flows into the second space V12 located at a side of the frame 102 through the driving motor 103.

As illustrated in FIGS. 1 and 2, the housing 111 may include a stator supporting surface (hereinafter, referred to as a first supporting surface) 111*a* formed on a middle of the inner circumferential surface thereof to support the stator 131 of the driving motor 103 in an axial direction, and a frame supporting surface (hereinafter, referred to as a second supporting surface) 111*b* formed on a rear side of the inner circumferential surface to support a rear surface of the frame 102 in the axial direction. The first supporting surface 111*a* may be formed in a ring shape with a stepped portion or in a shape with arcuate protrusions arranged in a circumferential direction with predetermined intervals.

Also, the housing 111 may be provided with an intake hole 101*a* connected with a suction pipe to guide a refrigerant into the suction space V1 of the housing 111. The intake hole 101*a* may be located between a front end of the driving motor 103, which corresponds to an opposite side of the compression unit based on the driving motor 103, and the front cover 113. Accordingly, the refrigerant may be introduced into an inner space of the casing 101 through the intake hole 101*a* and sucked into the compression unit 104 through the driving motor 103 from the front side to the rear side of the driving motor 103. In addition, the refrigerant may first be brought into contact with the front cover 113 before cooling the driving motor 103, so as to cool a switching element 166 attached to the front cover 113.

As illustrated in FIG. 1, the rear cover 112 may be formed in a disk shape, and provided with a coupling protrusion 112*a* that protrudes into a ring shape from an outer circumferential portion thereof toward a front side and is closely adhered on a rear surface of the housing 111. A sealing protrusion 112*b* which is inserted into an inner circumferential surface of the housing 111 and closely adhered in a radial direction may be formed on an inner circumferential surface of the coupling protrusion 112*a*.

A leakage-preventing sealing member 111*e*, such as an O-ring, for preventing a leakage of a discharged refrigerant may be provided between the rear cover 112 and the housing 111.

An exhaust hole 101*b* that is connected with a discharge pipe for guiding a refrigerant compressed in the compression unit 104 into a refrigeration cycle may be formed on a center of a front surface of the rear cover 112, and an oil separator 185 that separates oil from a discharged refrigerant may be provided within the exhaust hole 101*b*.

Meanwhile, the front cover 113 may be formed in a disk shape and hermetically coupled to a front surface of the housing 111. A sealing member 111*f*, such as an O-ring, may be provided on a contact portion between a rear surface (inner side surface) of the front cover 113 and the front surface of the housing 111.

The front cover 113 may be provided with a terminal mounting hole 113*a*, and a terminal 182 may be inserted into the terminal mounting hole 113*a* so as to connect an external power source to a coil of the driving motor 103. An inner side surface of the terminal mounting hole 113*a* may be formed in a stepped shape, and accordingly a flange 182*a* of the terminal 182 may be strongly locked on a stepped surface.

Here, the terminal 182 may be coupled to the front cover 113 in a welding manner or in a detachable manner using a separate fixing member 183.

Figure 3:
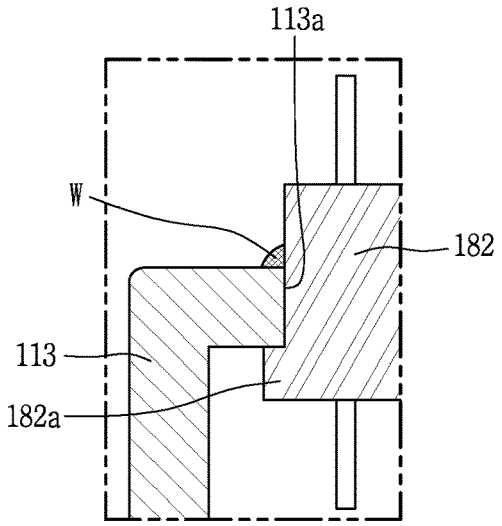
FIGS. 3 and 4 are longitudinal sectional views illustrating embodiments of a coupled state of a terminal in FIG. 2.
Figure 4:
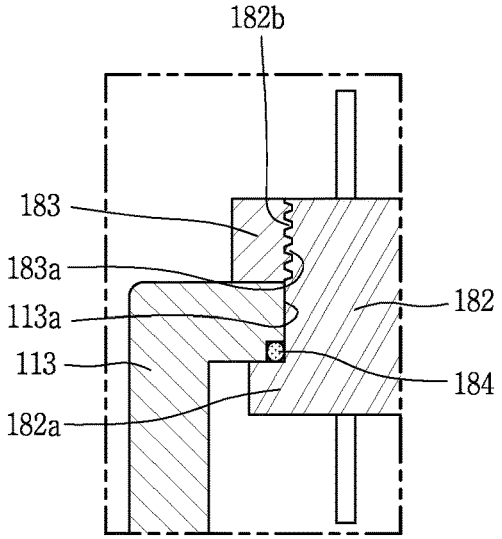

FIGS. 3 and 4 are longitudinal sectional views illustrating embodiments of a coupled state of a terminal in FIG. 2.

For the welding manner, as illustrated in FIG. 3, the flange 182*a* which has an outer diameter greater than an inner diameter of the terminal mounting hole 113*a* and thus is locked on an inner side surface of the front cover 113 may be provided on an inner side end portion of the terminal 182. An outer side end portion of the terminal 182 may be inserted through the terminal mounting hole 113*a* and welded on an outer side surface of the front cover 113.

Here, the terminal 182 may be made of an iron-based metal, and thus the front cover 113 may also be made of such iron-based metal. And, a sealing member such as an O-ring may be interposed between the flange 182*a* of the terminal 182 and an inner side surface of the front cover 113.

On the other hand, for coupling using a separate fixing member, as illustrated in FIG. 4, the flange 182*a* which has the outer diameter greater than the inner diameter of the terminal mounting hole 113*a* to be locked on the inner side surface of the front cover 113 may be formed on an inner side end portion of the terminal 182, and a male thread 182*b* that is coupled to a female thread 183*a* provided on an inner circumferential surface of the fixing member 183 may be formed on an outer side end portion of the terminal 182.

Accordingly, in a state that the flange 182*a* of the terminal 182 is locked on the inner side surface of the front cover 113 at a position adjacent to the terminal mounting hole 113*a*, the male thread 182*b* of the terminal 182 may be inserted through the terminal mounting hole 113*a* to be coupled to the female thread 183*a* of the fixing member 183 at an outer side of the front cover 113.

Here, the sealing member 184 such as an O-ring may be interposed between the flange 182*a* of the terminal 182 and the inner side surface of the front cover 113. Especially, in the method using the fixing member, unlike fixing the terminal in the welding manner, a portion between the terminal 182 and the front cover 113 is sealed by a tightening force of the fixing member, and thus the sealing member 184 may not always be necessary to be interposed between the terminal 182 and the front cover 113.

Therefore, although the terminal 182 is made of the iron-based metal, the front cover 113 may not have to be made of a heavy metal such as iron, but made of a relatively light aluminum material, thereby reducing an overall weight of the compressor.

Meanwhile, the control unit 106 may be provided on a front side of the front cover 113. The control unit 106 may be configured such that an inverter cover 161 having an inverter accommodating space V3 is coupled to the front surface of the front cover 113 and an inverter 162 for controlling a rotation speed of the driving motor 103 is coupled into the inverter accommodating space V3.

Figure 5:
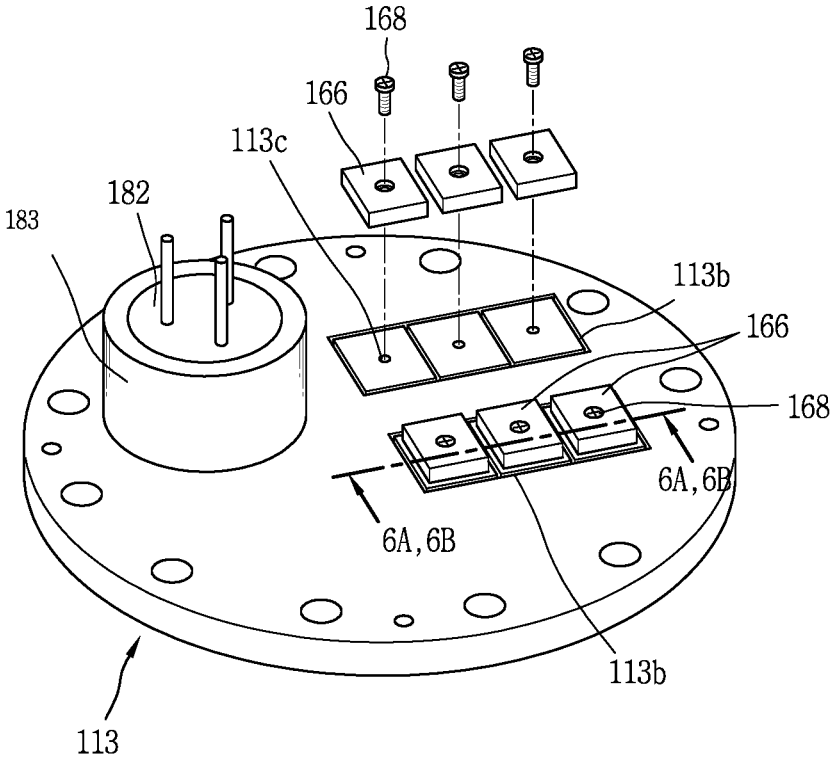
FIG. 5 is a perspective view of a front cover with elements separated from FIG. 2.
Figure 6A:
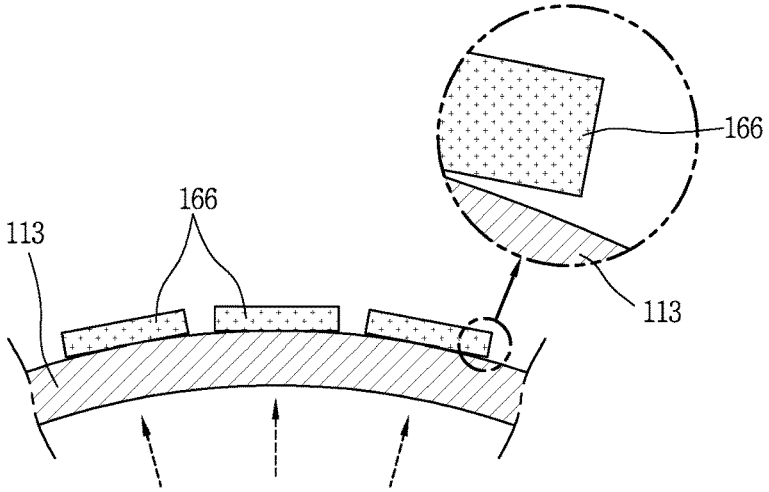
FIG. 6A is a longitudinal sectional view of an example according to the related art, taken along the line "6A-6A" of FIG. 5.
Figure 6B:
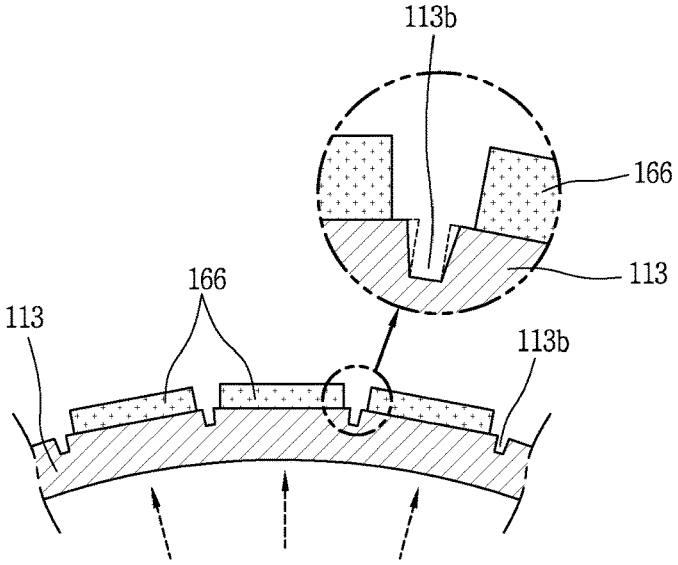
FIG. 6B is a longitudinal sectional view of an embodiment according to the present invention, taken along the line "6B-6B" of FIG. 5.
Figure 7A:
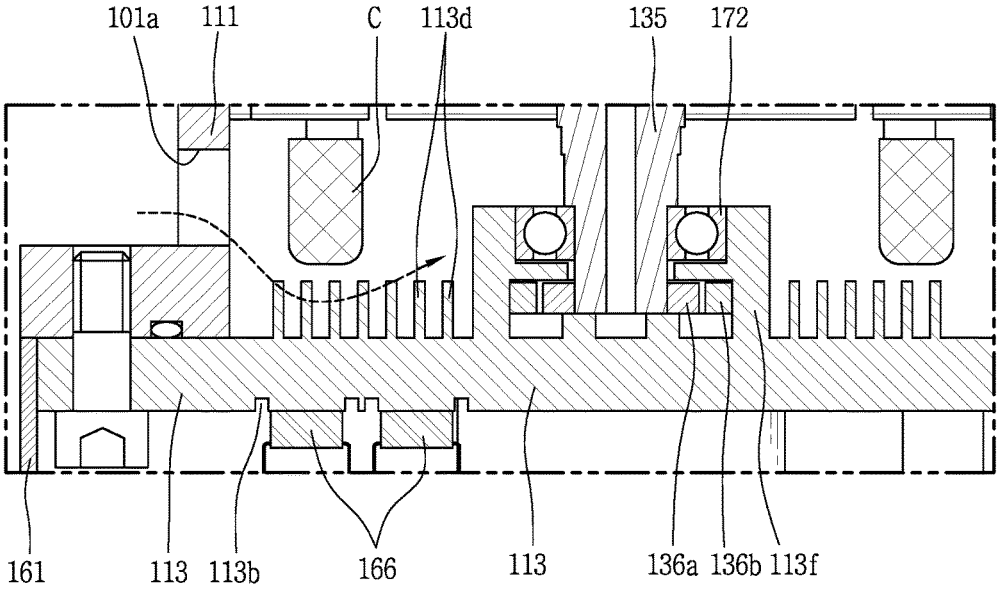
FIGS. 7A and 7B are longitudinal sectional views illustrating heat sink fins and heat sink recesses provided on an inner side surface of the front cover of FIG. 2.
Figure 7B:
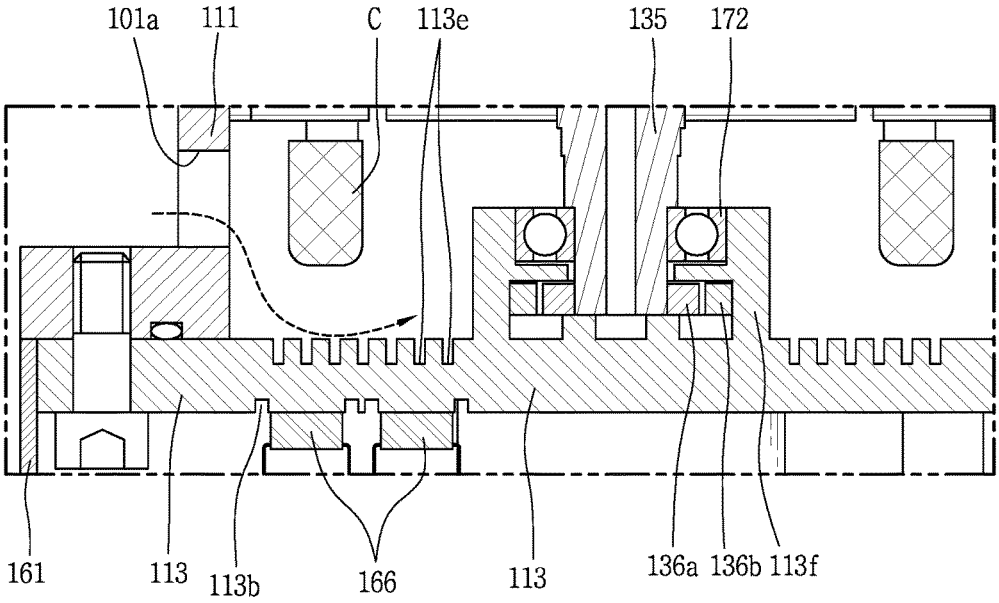
Figure 8:
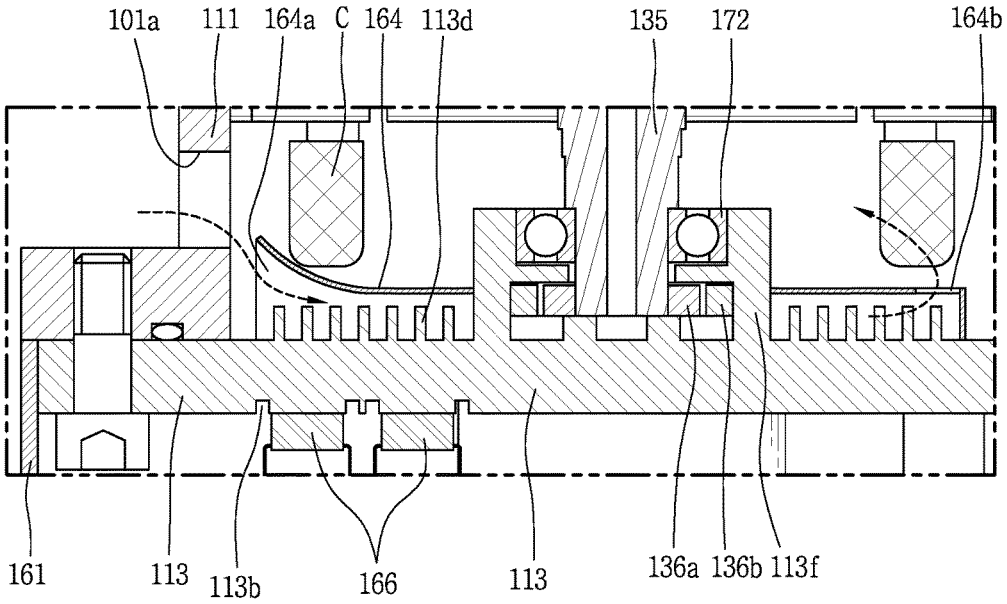
FIGS. 8 and 9 are a longitudinal sectional view and a planar view of a heat sink chamber provided on the inner side surface of the front cover of FIG. 2.
Figure 9:
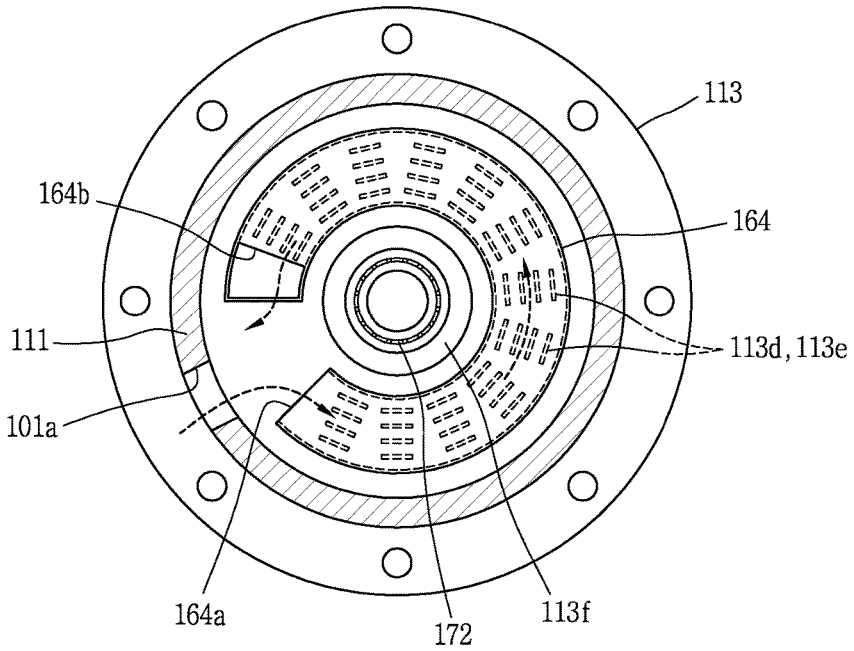

FIG. 5 is a perspective view of a front cover with elements separated from FIG. 2, FIG. 6A is a longitudinal sectional view of an example according to the related art, taken along the line "6A-6A" of FIG. 5, FIG. 6B is a longitudinal view of an embodiment according to the present invention, taken along the line "6B-6B" of FIG. 5, FIGS. 7A and 7B are longitudinal sectional views illustrating heat sink fins and heat sink recesses provided on an inner side surface of the front cover of FIG. 2, and FIGS. 8 and 9 are a longitudinal sectional view and a planar view of a heat sink chamber provided on the inner side surface of the front cover of FIG. 2.

As illustrated in FIGS. 1 and 5, the inverter 162 may include a plurality of switching elements (Insulated Gate Bipolar Transistor (IGBT) 166 attached to the front surface of the front cover 113, and an inverter substrate 167 provided on a front side of the switching elements 165.

The switching element 166 generates high heat during the operation of the compressor. To radiate the heat, a heat transfer member such as a thermal sheet may be attached to the front surface of the front cover 113 and then the switching elements 166 may be attached to a front surface (i.e., outer side surface) of the heat transfer member.

However, if the thermal sheet is used, the number of components may increase, which causes an increase in material costs, thereby increasing the number of assembly processes.

In addition, in a compressor using a high pressure refrigerant, such as $CO_2$ refrigerant, internal pressure of the casing 101 greatly increases as compared with a compressor using a typical refrigerant such as 134*a* refrigerant. Accordingly, the front cover 113 may elastically expanded like being inflated, and thereby a surface of each of the switching elements 166 that is brought into contact with the front cover 113 becomes curved as illustrated in FIG. 6A. This may reduce a contact area between the front cover 113 and the switching element 166, thereby lowering a coupling force with respect to the switching element 166 or reducing a heat dissipation effect.

Considering this, as illustrated in FIG. 5, a deformation-preventing groove 113*b* with predetermined depth and width may be formed on a front surface of the front cover 113, namely, around each of the switching elements 166. The deformation-preventing groove 113*b* may be formed to surround a periphery of the switching element 166. Accordingly, as illustrated in FIG. 6B, even though the front cover 113 is inflated due to the internal pressure, the deformation-preventing groove 113*b* may open wide and minimize the deformation of the front cover 113. This may allow for ensuring a wide contact area between the switching element 166 and the front cover 113, thereby effectively radiating heat of the switching element 166 even without the use of the separate thermal sheet.

In addition, as illustrated in FIG. 5, each of the switching elements 166 may also be coupled to the front cover 113 using a screw 168. As a separate adhesive member such as a thermal sheet is not provided between the switching element 166 and the front cover 113, the screw coupling may be facilitated. Accordingly, the switching element 166 may be firmly fixed to the front cover 113 in a more stable manner. A non-explained reference numeral 113*c* denotes a screw hole.

The front cover 113, as illustrated in FIGS. 7A and 7B, may also be provided with heat sink fins 113*d* or heat sink recesses 113*e* formed on an inner side surface thereof. These may increase a heat transfer area between the front cover 113 and a refrigerant, thereby further enhancing the heat dissipation effects with respect to the switching elements 166.

Here, when the heat sink fins 113*d* or the heat sink recesses 113*e* are formed, the heat sink fins 113*d* or the heat sink recesses 113*e* may be formed in a direction intersecting with an axial direction of the intake hole 101*a* to increase the contact area with the refrigerant. However, in some cases, the heat sink fins 113*d* or the heat sink recesses 113*e* may be formed in the same direction as the axial direction, thereby increasing a flow speed of the refrigerant. Also, the shape of the heat sink fins 113*d* or the heat sink recesses 113*e* may be configured to correspond to the deformation of the front cover 113, similar to the deformation-preventing groove 113*b*.

The heat sink fin 113*d* or the heat sink recess 113*e* may also be formed in a linear shape. Also, the heat sink fin 113*d* or the heat sink recess 113*e* may be formed in a curved shape or a shape like a maze for allowing the refrigerant to evenly circulate along the front cover 113.

Meanwhile, as illustrated in FIGS. 8 and 9, a heat sink chamber 164 may be installed on an inner side surface of the front cover 113 to forcibly induce a refrigerant toward the inner side surface of the front cover 113.

In this instance, an inlet 164*a* of the heat sink chamber 164 may be formed toward the intake hole 101*a*, whereas an outlet 164*b* thereof may be formed toward the inner space of the casing 101. The inlet 164*a* and the outlet 164*b* may be formed on the same line, but preferably formed, if possible, on different lines from each other for allowing the refrigerant to evenly circulate the inner space of the heat sink chamber 164.

The inlet 164*a* may also be spaced apart from the intake hole 101*a* provided on the casing 101 by a predetermined interval. Alternatively, the inlet 164*a* of the heat sink chamber 164 may also be connected directly to an inner side end of the intake hole 101*a*.

However, according to surrounding conditions, such as a coil of the stator 131 and the like, the inlet 164*a* of the heat sink chamber 164 may extend to be adjacent to the intake hole 101*a* as much as possible, or a direction of the intake hole 101*a* may be inclined toward the inlet 164*a* of the heat sink chamber 164.

Even in those cases, the heat sink fins 113*d* or the heat sink recesses 113*e* may also be formed on the front surface of the front cover 113 within the heat sink chamber 164.

Accordingly, a refrigerant that is introduced into the inner space of the casing 101 through the intake hole 101*a* may flow into the heat sink chamber 164 through the inlet 164*a* of the heat sink chamber 164 and then move into the inner space (first space) V11 of the casing 101 through the outlet 164*b*.

Consequently, the cold refrigerant introduced into the inner space of the casing 101 may be brought into contact with the front cover 113 and cool the front cover 113, thereby effectively cooling the switching elements 166 attached to the front cover 113.

Meanwhile, the frame may form a space together with the fixed scroll and the orbiting scroll. The space may be a back pressure space which supports the orbiting scroll toward the fixed scroll by internal pressure of the back pressure space.

Figure 10:
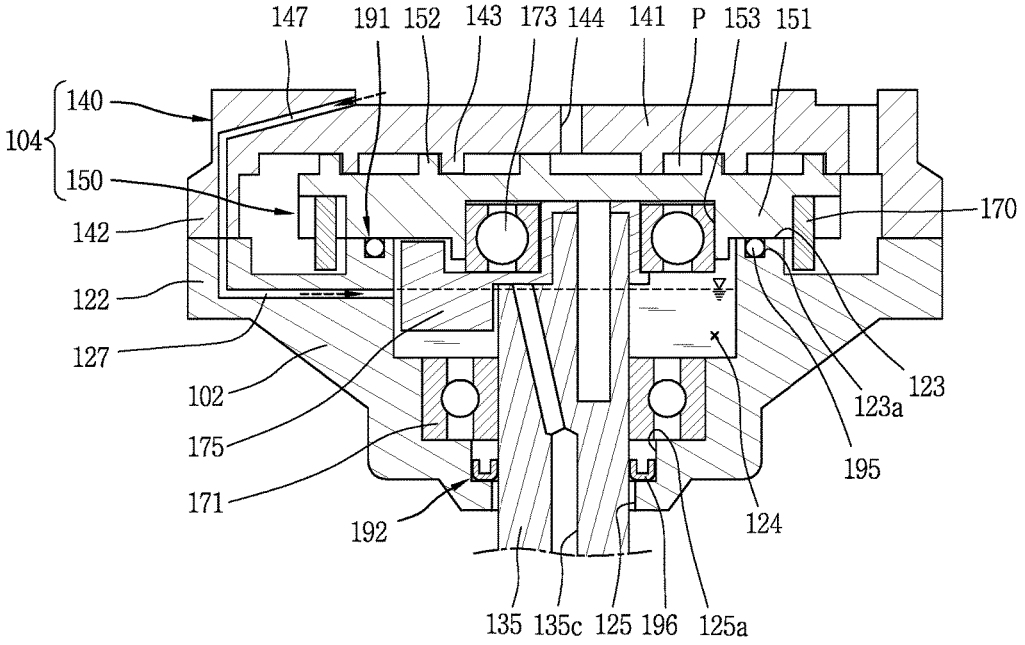
FIG. 10 is a longitudinal sectional view of a compression unit for illustrating one embodiment of a sealing portion of a back pressure space in the scroll compressor according to FIG. 1.
Figure 11:
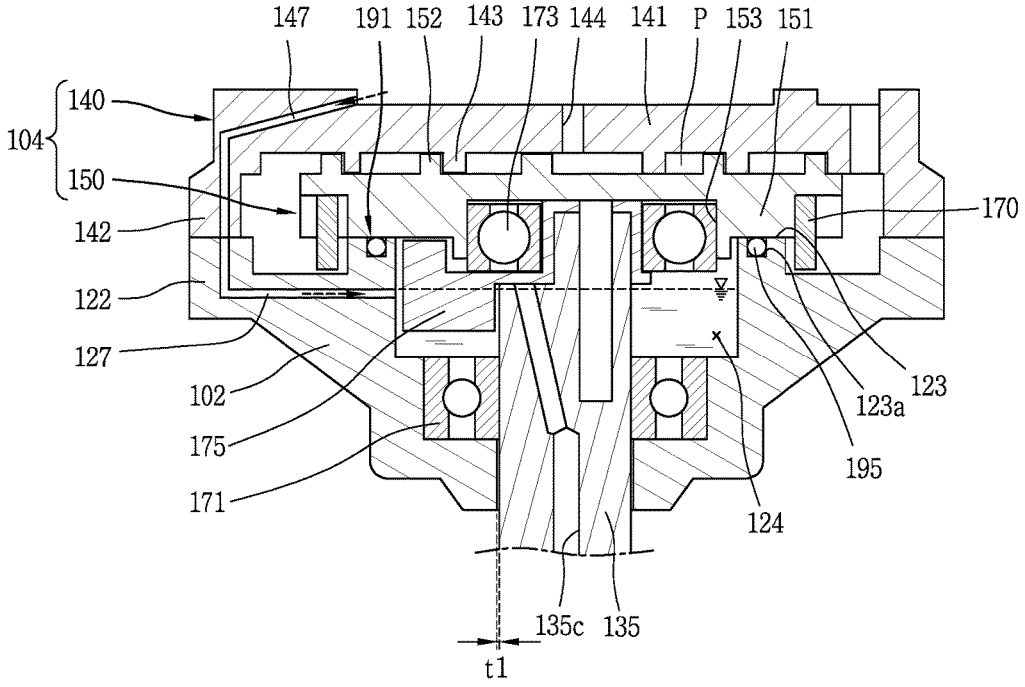
FIG. 11 is a longitudinal sectional view of a compression unit for illustrating another embodiment of a sealing portion of a back pressure space in the scroll compressor according to FIG. 1.
Figure 12:
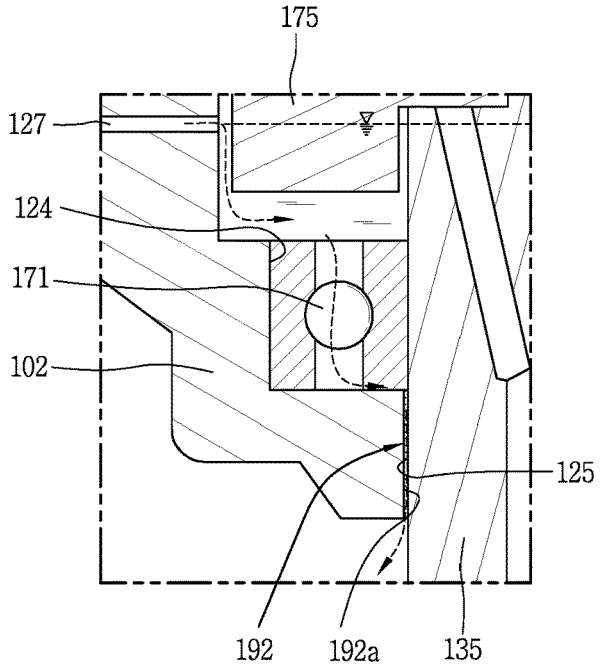
FIG. 12 is a longitudinal sectional view illustrating a back pressure hole and a second sealing portion, in an enlarged state, disposed between a rotation shaft and a frame.
Figure 13:
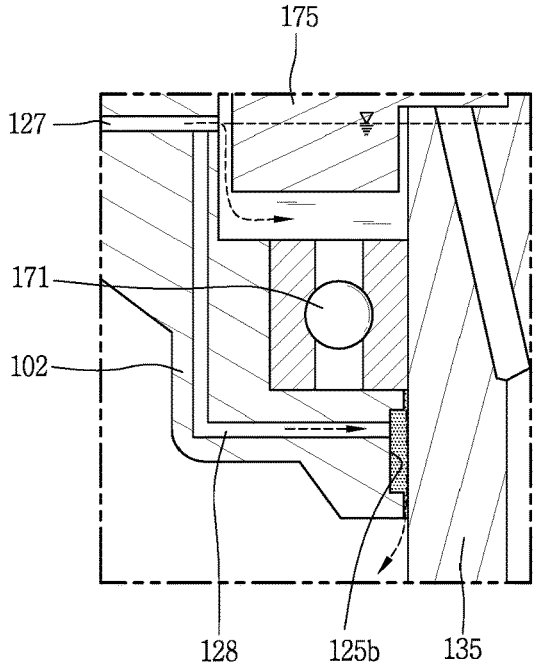
FIGS. 13 and 14 are longitudinal sectional views illustrating another embodiments of the second sealing portion in FIG. 12.
Figure 14:
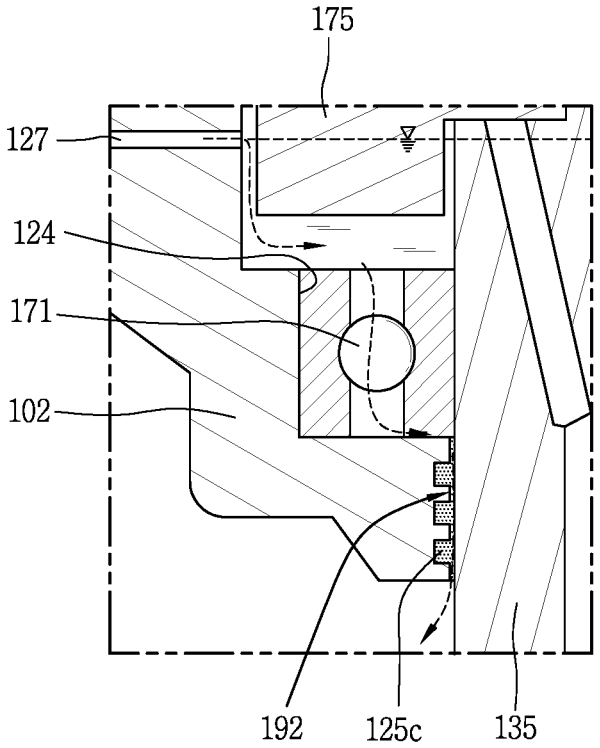

FIG. 10 is a longitudinal sectional view of the compression unit for illustrating one embodiment of a sealing portion of a back pressure space in the scroll compressor according to FIG. 1, FIG. 11 is a longitudinal sectional view of the compression unit for illustrating another embodiment of a sealing portion of a back pressure space in the scroll compressor according to FIG. 1, FIG. 12 is a longitudinal sectional view illustrating a back pressure hole and a second sealing portion, in an enlarged state, disposed between a rotation shaft and a frame, and FIGS. 13 and 14 are longitudinal sectional views illustrating another embodiments of the second sealing portion in FIG. 12.

The frame 102, as illustrated in FIG. 1, may be fixedly inserted into an open end of the housing 111. The frame 102 may be supported in an axial direction by being laid on the second supporting surface 111*b* provided on the inner circumferential surface of the front end portion of the housing 111.

The frame 102 may include a frame-side disk portion (hereinafter, referred to as a first disk portion) 121 formed in a disk shape, and a frame-side side wall portion (hereinafter, referred to as a first side wall portion) 122 protruding from a front surface of the first disk portion 121 and coupled with a second side wall portion 142 of the fixed scroll 140 to be explained later. A thrust surface 123 on which the orbiting scroll 150 is laid and supported in an axial direction may be formed at an inner side of the first side wall portion 122, and a back pressure space 124 that is filled with a part of a refrigerant discharged from the compression chamber P so as to support a rear surface of the orbiting scroll 150 may be formed at a center of the thrust surface 123. A shaft hole 125 through which the rotation shaft 135 is inserted may be formed through a central portion of the back pressure space 124, and a main bearing 171 to be explained later may be disposed on an upper surface of the shaft hole 125.

Here, the back pressure space 124 is a space that is formed by the frame 102, the fixed scroll 140 and the orbiting scroll 150. The back pressure space 124 may be hermetically sealed by a first sealing portion 191 disposed on the thrust surface (or a sealing surface) 123 between the frame 102 and the orbiting scroll 150, and a second sealing portion 192 disposed between the shaft hole 125 of the frame 102 and an outer circumferential surface of the rotation shaft 135.

The first sealing portion 191 may be provided with a first sealing recess 123*a* formed on the thrust surface 123 of the frame 102 and having a ring shape with a predetermined depth, and a first sealing member 195 also formed in a ring shape may be inserted into the first sealing recess 123*a*. The first sealing member 195 may be raised up by being pushed due to a force, which is generated by pressure of the back pressure chamber 124, and closely adhered on the orbiting scroll 150, thereby sealing the back pressure space 124.

The second sealing portion 192, as illustrated in FIG. 10, may be provided with a second sealing recess 125*a* formed on an inner circumferential surface of the shaft hole 125 of the frame 102, and a second sealing member 196 formed in a ring shape may be inserted into the second sealing recess 125*a*.

However, when a high pressure refrigerant such as $CO_2$ refrigerant is used, pressure of the back pressure chamber 124 may drastically increase. However, if the pressure of the back pressure space 124 is high, a contact area between the second sealing member 196 and the rotation shaft 125 may increase, which may result in increasing a frictional loss between the second sealing member 196 and the rotation shaft 125.

Considering this, as illustrated in FIGS. 11 and 12, the second sealing portion may be configured by using viscosity of oil, instead of using a solid sealing member. This may result in effectively reducing the frictional loss with the rotation shaft while maintaining high pressure of the back pressure space.

That is, as the second sealing portion 192 forms a fine sealing interval t1 between the inner circumferential surface of the shaft hole 125 and the outer circumferential surface of the rotation shaft 135, oil may be introduced between the inner circumferential surface of the shaft hole 125 and the outer circumferential surface of the rotation shaft 135, thereby forming an oil layer 192*a*. The oil layer 192*a* may allow the pressure of the back pressure space 124 to be maintained.

Here, the oil filled in the second sealing portion 192 may be oil which is introduced into the back pressure space 124 together with a refrigerant discharged from the compression chamber P. To this end, back pressure holes through which a part of the refrigerant discharged from the compression chamber P is introduced into the back pressure space 124 together with the oil may be formed in the fixed scroll 140 and the frame 102.

That is, a first back pressure hole 147 may be formed on a rear surface of the fixed scroll 140 in a manner of penetrating through the second side wall portion 142, and a second back pressure hole 127 that communicates with the first back pressure hole 147 of the fixed scroll 140 may be formed on a rear surface of the first side wall portion 121 of the frame 102 in a manner of penetrating through an inner wall surface of the back pressure space 124.

Here, an outlet end 127*a* of the second back pressure hole 127 may preferably be high enough that oil can be filled in the back pressure space 124 as much as the oil layer being always maintained in the second sealing portion 192, namely, high enough that a balance weight 175 rotating in the back pressure space 124 is sunk approximately by half or less, in terms of preventing an increase in a load or noise in a motor due to stirring of the balance weight 175.

In this instance, in order to always maintain a constant amount of oil filled in the back pressure space 124, an amount of oil discharged out of the back pressure space 124 should be greater than or at least the same as an amount of oil introduced into the back pressure space 124. To this end, an entire sectional area (more exactly, a sectional area except for an oil layer formed due to viscosity) of the second sealing portion 192 is preferably smaller than or at least the same as an entire sectional area of the second back pressure hole 127.

Meanwhile, an oil pocket in which a predetermined amount of oil can be filled may be formed in the second sealing portion 192. For example, as illustrated in FIG. 13, an oil pocket 125*b* with a predetermined volume may be formed on an inner circumferential surface of the shaft hole 125 or on an outer circumferential surface of the rotation shaft 135 corresponding to the inner circumferential surface of the shaft hole 125.

In this instance, an oil supply hole 128 for supplying oil directly into the oil pocket 125*b* may also be formed. The oil supply hole 128 may be formed through the fixed scroll 140 and the frame 102, separate from the back pressure hole 127, or formed by being branched off from a middle of the back pressure hole. Accordingly, when the compressor is started, oil can fast flow into the oil pocket 125*b* and form the second sealing portion 192, thereby fast generating appropriate pressure of the back pressure space 124.

Also, as illustrated in FIG. 14, a reverence chamber 125*c* may further be formed on the inner circumferential surface of the shaft hole 125. This may prevent a leakage of the oil of the back pressure chamber through the second sealing portion 192 or prevent a leakage of pressure of the back pressure space 124 before the oil is filled in the back pressure chamber 124.

Meanwhile, the stator of the driving motor may be press-fitted into the housing.

Figure 15:
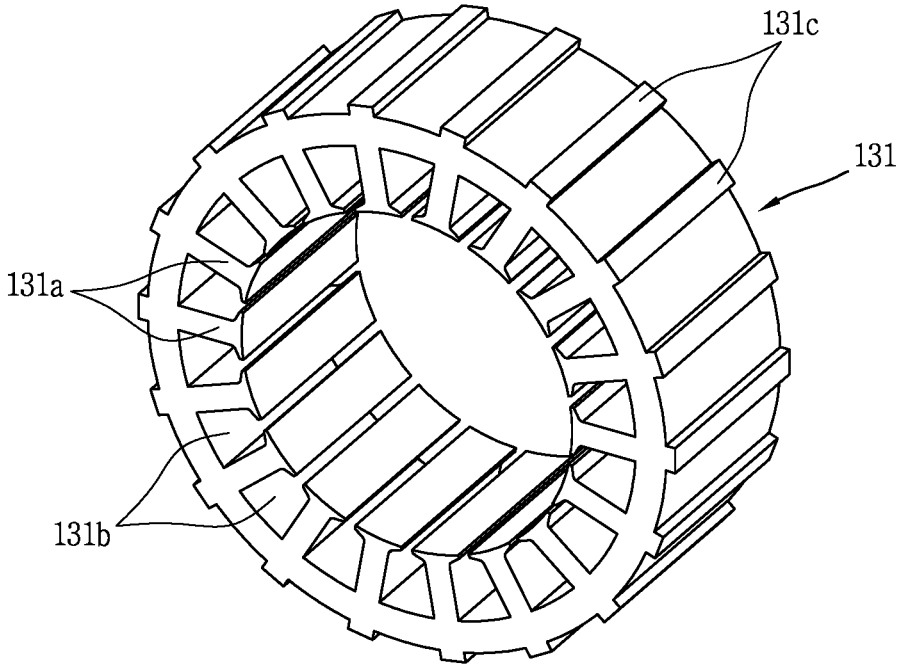
FIG. 15 is a perspective view of a stator of the scroll compressor according to FIG. 1.
Figure 16:
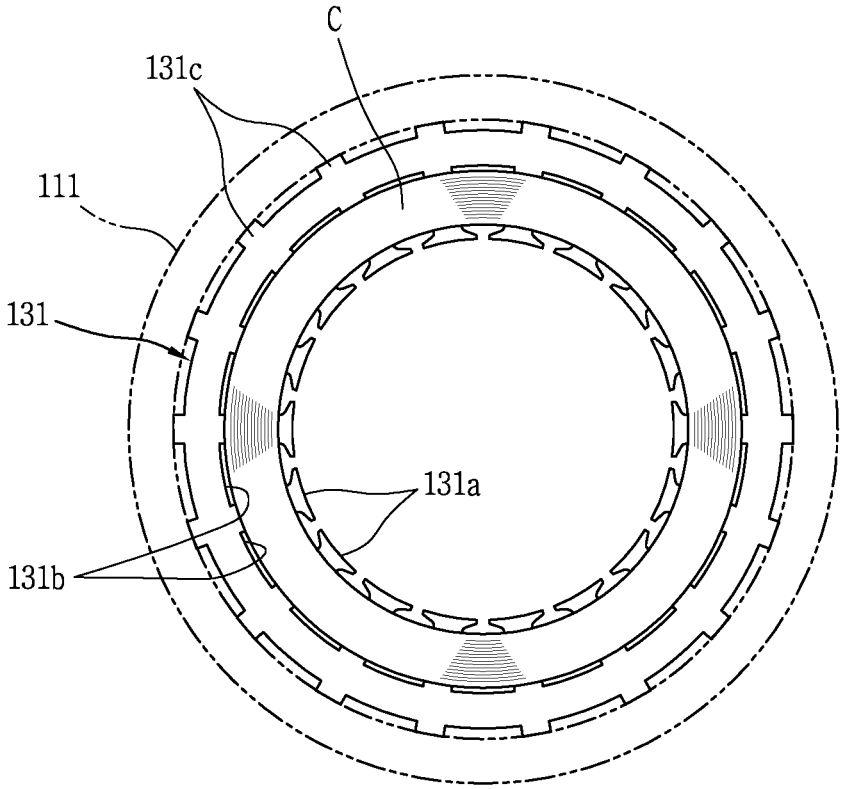
FIG. 16 is a front view illustrating a state in which the stator of FIG. 15 is press-fitted in a housing.
Figure 17:
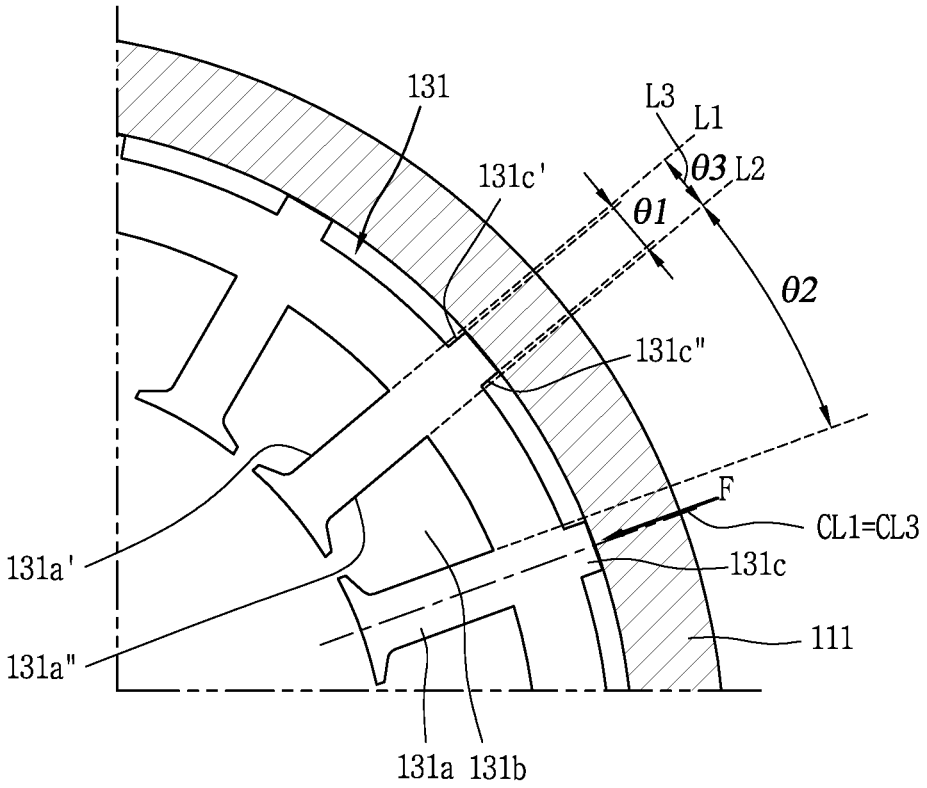
FIG. 17 is a longitudinal sectional view illustrating a partially-enlarged state of the stator of FIG. 16.
Figure 18:
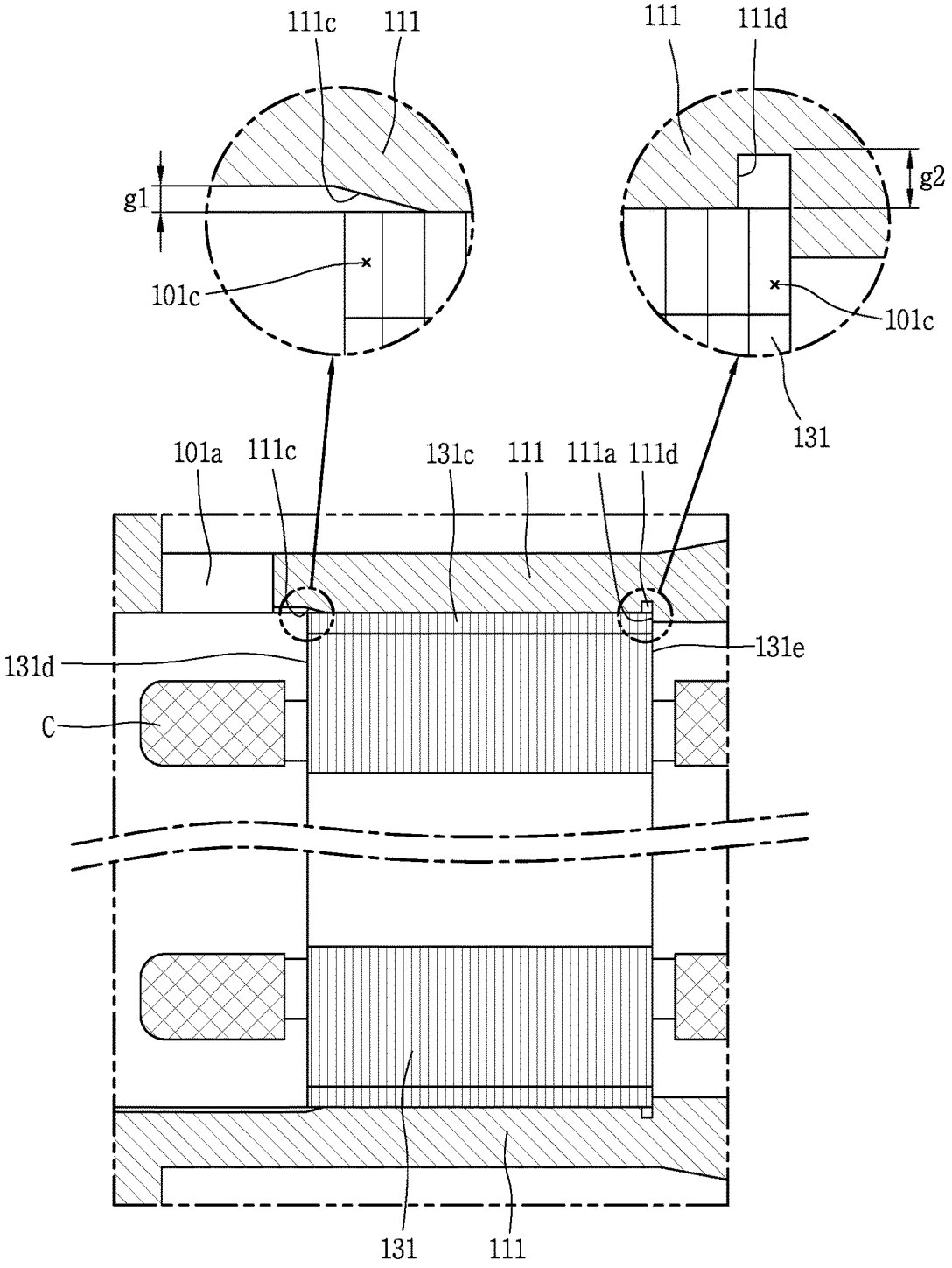
FIG. 18 is a longitudinal sectional view illustrating a state that the stator is press-fitted in the housing in the scroll compressor according to FIG. 1.

FIG. 15 is a perspective view of a stator of the scroll compressor according to FIG. 1, FIG. 16 is a front view illustrating a state in which the stator of FIG. 15 is press-fitted in a housing, FIG. 17 is a longitudinal sectional view illustrating a partially-enlarged state of the stator of FIG. 16, and FIG. 18 is a longitudinal sectional view illustrating a state that the stator is press-fitted in the housing in the scroll compressor according to FIG. 1.

As illustrated in FIG. 1, the driving motor 103 may include the stator 131 fixed into the housing 111, and the rotor 132 located within the stator 131 and rotated by interaction with the stator 131. The stator 131 may be shrink-fitted into the housing 111, and a rear end of the stator 131, as aforementioned, may be supported by being laid on the first supporting surface 111*a* provided on the inner circumferential surface of the housing 111.

As illustrated in FIG. 15, the stator 131 may be formed by laminating a plurality of thin iron plates, and provided with a plurality of teeth 131*a* and slots 131*b* which are consecutively formed on the inner circumferential surface thereof in an alternating manner such that a coil C can be wound therearound.

A plurality of supporting protrusions 131*c* may be formed on an outer circumferential surface of the stator 131. The plurality of supporting protrusions 131*c* may be spaced apart from one another by predetermined intervals between the stator 131 and the inner circumferential surface of the housing 111, so as to form communication channels 101*c* along which a refrigerant or oil can flow when the stator is press-fitted into the inner circumferential surface of the housing 111. The supporting protrusions 131*c* may be formed between both ends of the stator 131 in an axial direction of the stator 131, and spaced apart from one another by predetermined intervals in a circumferential direction.

As illustrated in FIGS. 16 and 17, the supporting protrusions 131*c* may be formed to be located on the same line with the teeth 131*a* in a radial direction or within a range of a radial direction of the teeth 131*a*.

For example, when the stator 131 is press-fitted into the housing 111, the supporting protrusions 131*c* of the stator 131 may be closely adhered on the inner circumferential surface of the housing 111 and accordingly intensively receive a pressing force F. The pressing force F is transferred to the teeth 131*a* or slots 131*b* formed on the inner circumferential surface of the stator 131.

However, if a position of each of the supporting protrusions 131*c*, namely, an arcuate length range θ1 of each supporting protrusion is located within a circumferential length range θ2 of each of the slots 131*b*, the supporting protrusion 131*c* is pressed onto the housing 111 and the pressing force F is transferred to the slot 131*b*, thereby opening wide the teeth 131*a* located at both sides of each slot 131*b*. When the teeth 131*a* located at both sides of the slot 131*b* open wide, the entire stator may be deformed and thereby cause friction against the rotor 132.

Therefore, it is important to prevent the force F, which is generated in response to the supporting protrusion 131*c* being pressed onto the housing 111, from being transferred to the slot 131*b* of the stator, if possible. To this end, the supporting protrusion 131*c* may be formed on the same line CL1, CL3 with the corresponding tooth 131*a* in the radial direction, thereby minimizing the transfer of the pressing force F applied to the supporting protrusion 131*c* to the slot 131*b* and offsetting the force F by the tooth 131*a*.

In this embodiment, the arcuate length range θ1 of the supporting protrusion 131*c* may be within an arcuate length range θ3 of the tooth 131*a*. Here, the arcuate length range θ3 of the tooth 131*a* refers to an arcuate length θ3, which is generated by drawing two virtual lines L1 and L2 which extend from both side surfaces 131*a*' and 131*a*" of each of the teeth 131*a*, which are located in a circumferential direction, toward outside in a horizontal direction and connecting both of the virtual lines L1 and L2 to each other with an arcuate line L3. Both ends of the supporting protrusion 131*c* may be at least the same as the arcuate length range θ3 of the tooth 131*a* or located within the range.

Here, only at least one of both ends 131*c*' and 131*c*" of the supporting protrusion 131*c* may be located within the range θ3 and the other end may be located out of the range θ3. However, in some cases, a center line CL3 passing through a right center of the arcuate length of the supporting protrusion 131*c* may preferably be located within the arcuate length range of the tooth 131*a*, such that more than a half of the arcuate lengths θ3 of the supporting protrusion 131*c* can be located within the range.

Also, the arcuate length of the supporting protrusion 131*c* may preferably be smaller than or equal to the arcuate length (width length) of the tooth 131*a*. If the arcuate length of the supporting protrusion 131*c* is greater than the width length of the tooth 131*a*, the pressing force transferred to the supporting protrusion 131*a* may be transferred to the slots 131*b* and thereby the slots 131*b* may open wide from each other. Therefore, if possible, the arcuate length of the supporting protrusion 131*c* may preferably be formed smaller than the arcuate length of the tooth 131*a* and not formed greater than at least the arcuate length of the tooth 131*a*.

Accordingly, even though the supporting protrusion 131*c* receives the pressing force F from the housing 111 due to being closely adhered on the housing 111, the force may not be transferred to the slots 131*b* and mostly transferred to the tooth 131*a* to be offset, thereby preventing in advance a change in an interval between the teeth 131*a* of the stator.

Also, when press-fitting the stator into the housing, a load may be concentrated from the housing on both ends of the stator. Therefore, as illustrated in FIG. 18, a stress reducing portion may be formed on the inner circumferential surface of the housing 111 so as to prevent the concentration of the stress on the both ends of the stator 131 when press-fitting the stator 131. The stress reducing portion may be implemented as a tilt surface 111*c* or an undercut 111*d* formed on the inner circumferential surface of the housing 111.

The tilt surface 111*c* may be formed in a shape that an inner diameter is greater at a side where the stator 13 starts to be press-fitted, namely, the inner diameter extends toward a front end of the housing 111. Accordingly, when the stator 131 is press-fitted, the stator 131 can be press-fitted along the tilt surface 111*c*, which may facilitate press-fitting of the stator 131. In addition, since an outer circumferential surface of a front end 131*d* of the stator 131 and the inner circumferential surface of the housing 111 are spaced apart from each other by a predetermined gap g1 after press-fitting the stator 131, a concentration of stress on the front end 131*d* of the stator 131 due to the housing 111 can be prevented in advance although the housing 111 is shrunk.

The undercut 111*d* may be formed to have predetermined depth and width within a range including a rear end 131*e* of the stator 131, at a position where a rear end 131*e* of the stator 131 is press-fitted, namely, at a rear side of the housing 111. Accordingly, since the rear end 131*e* of the stator 131 and the inner circumferential surface of the housing 111 are spaced apart from each other by a predetermined gap g2 in the press-fitted state of the stator 131, a concentration of stress on the stator 131 due to the housing 111 can be prevented in advance although the housing is shrunk. The undercut 111*d* may be formed in a manner of extending from a front side of the first support surface 111*a*.

Meanwhile, as illustrated in FIG. 1, the rotation shaft 135 may include a shaft portion 135*a* coupled to the rotor 132, and an eccentric portion 135*b* coupled to a boss 153 provided on the orbiting scroll 150. The eccentric portion 135*b* may be inserted into an eccentric bearing 173 to be explained later and transfer a rotation force to the orbiting scroll 150.

An oil passage 135*c* for supplying oil to a sliding portion is formed in the rotation shaft 135, and an oil pump 136 for pumping oil stored in the discharge space V2 of the casing 101 into the oil passage 135*c* may be provided at a rear end of the oil passage 135*c*. The oil pump 136 may be configured as a trochoidal gear pump. An inner ring 136*a* of the oil pump 136 may be coupled to the rotation shaft 135 and an outer ring 136*b* thereof may be inserted into a pump inserting portion 113*f* provided on a rear side of the front cover 113.

Both front and rear sides of the shaft portion 135*a* based on the rotor 132 may be supported in a radial direction by a main bearing 171 and a sub bearing 172, respectively.

The main bearing 171 may be configured as a ball bearing having an outer ring inserted into the frame 102 and an inner ring inserted into the rotation shaft 135. The sub bearing 172 may be configured as a ball bearing having an outer ring inserted into the pump inserting portion 113*f* and an inner ring inserted into the rotation shaft 135.

Meanwhile, the fixed scroll 140 may be provided with a fixed-side disk portion (hereinafter, referred to as a second disk portion) 151 formed in a disk shape, a fixed-side side wall portion (hereinafter, referred to as a second side wall portion) 142 protruding from one side surface of the second disk portion 141 toward the frame 102, and a fixed wrap 143 formed on a central portion of the second disk portion 141 and engaged with an orbiting wrap 152 to be explained later so as to form a pair of compression chambers P.

A suction hole (not illustrated) which communicates with the suction space V1 of the casing 101 may be formed on an edge of the second disk portion 141, and a discharge hole 144 through which a final compression chamber communicates with the discharge space V2 may be formed through a central portion of the second disk portion 141. The first back pressure hole 147 may be formed at one side of the outlet port 144 such that a refrigerant and oil discharged through the discharged hole 144 can partially be guided into the back pressure space 124.

The orbiting scroll 150 may include an orbiting-side disk portion (hereinafter, referred to as a third disk portion) 151 formed in a disk shape, an orbiting wrap 152 protruding from a front surface of the third disk portion 151 toward the second disk portion 141 and engaged with the fixed wrap 143, and a boss 153 formed on a rear surface of the third disk portion 151 and coupled to the rotation shaft 135 with the eccentric bearing 173 interposed therebetween so as to receive the rotation force.

An unexplained reference numeral 170 denotes an Oldham ring as an anti-rotation member.

Hereinafter, an assembly process of the scroll compressor according to the embodiment will be described.

That is, the stator 131 of the driving motor 103 is shrink-fitted into the housing 111. In this instance, the rear end of the stator 131 may be mounted on the first supporting surface 111*a* provided on the inner circumferential surface of the housing 111, thereby preventing a backward movement of the stator 131.

As the supporting protrusions 131*c* provided on the outer circumferential surface of the stator 131 are closely adhered on the inner circumferential surface of the housing 111, pressing force F may be applied to the supporting protrusions 131*c*. However, the supporting protrusions 131*c* may be formed on the same lines as the teeth 131*a* of the stator 131, respectively. Therefore, the pressing force F may not be transferred toward the slots 131*b* but transferred to the teeth 131*a*. Accordingly, the pressing force F may be offset by the teeth 131*a*, thereby preventing the slots 131*b* from opening wide.

Also, stress may be concentrated on the both ends 131*d* and 131*e* of the stator 131 in the press-fitted state of the stator 131. However, by forming the tilt surface 111*c* and the undercut 111*d* on the inner circumferential surface of the housing 111 corresponding to the both ends of the stator 131, respectively, the spaced gaps g1 and g2 may be generated between the inner circumferential surface of the housing 111 and the both ends 131*d* and 131*e* of the stator 131, thereby solving the stress concentration on the both ends 131*d* and 131*e* of the stator 131 in the radial direction. This may result in preventing a deformation of the stator after being press-fitted.

Next, the rotor 132 coupled with the rotation shaft 135 is inserted into the stator 131. In this instance, the sub bearing 172 is fixedly inserted into the rotation shaft 135.

The frame 102 is then mounted and coupled to the housing 111. In this instance, a rear surface of the frame 102 is mounted on the second supporting surface 111*b* which is provided on the housing 111, thereby preventing the frame 102 from being moved in an axial direction.

Next, after the anti-rotation member 170, the orbiting scroll 150 and the fixed scroll 140 are laid on the frame 102, the fixed scroll 140 is coupled to the frame 102 using bolts. The front cover 113 is laid on a front surface of the housing 11 and coupled thereto using bolts, and then the inverter cover 161 is coupled, thereby completely assembling the scroll compressor.

Alternatively, the front cover 113 may be coupled to the housing 111 after first coupling the inverter cover 161 to the front cover 113. In this instance, various elements 166 for controlling an inverter and an inverter PCB 176 having the elements 166 coupled thereto are coupled to an outer side surface of the front cover 113 using bolts. The terminal 182 is coupled to the terminal mounting hole 113*a* in a wielding manner W or using the coupling member 183.

Accordingly, the terminal 182 may be coupled to the front cover 113 in a completely sealed state. Therefore, in a compressor using a high pressure refrigerant such as $CO_2$ refrigerant, the assembled portion of the terminal 182 cannot be damaged even though internal pressure of the casing 101 is increased. Specifically, when the terminal 182 is assembled using the coupling member 183, the front cover 113 can be fabricated using a material which is lighter than a material of the casing, thereby reducing the weight of the compressor that much. At the same time, the terminal 182 can be recycled even though the front cover 113 is replaced due to being damaged, thereby reducing maintenance costs.

The scroll compressor according to the embodiment will provide the following operation effects.

That is, when power is applied to the driving motor 103, the rotation shaft 135 is rotated along with the rotor 132 of the driving motor 103, and transfers the rotation force to the orbiting scroll 150.

The orbiting scroll 150 accordingly performs an orbiting motion by an eccentric distance by virtue of the eccentric portion 135*b* of the rotation shaft 135 and the anti-rotation member 170. Accordingly, the compression chambers P are reduced in volume while continuously moving toward a center.

The refrigerant is then introduced into the first space V11 through the intake hole 101*a*, as indicated with an arrow. The refrigerant introduced in the first space V11 flows toward the compression unit through the communication passage 101*c* formed between the outer circumferential surface of the stator 131 of the driving motor 103 and the inner circumferential surface of the housing 111 or through an air gap between the stator and the rotor, thereby being sucked into the compression chambers P. In this instance, as the front cover 113 forms the first space V11 together with the housing 111, the refrigerant sucked into the first space V11 through the intake hole 101*a* is first brought into contact with the inner side surface of the front cover 113 before flowing into the second space V12 through the driving motor 103. Therefore, the front cover 113 is cooled by heat exchange with the sucked cold refrigerant, which may allow for fast cooling heat generated from the switching elements 166 attached to an outer side surface of the front cover 113. Afterwards, the refrigerant cools even the driving motor while flowing through the stator 131.

The refrigerant sucked into the compression chambers P is compressed while moving toward the center along a moving path of the compression chambers P, and then discharged into the discharge space V2 formed between the fixed scroll 140 and the rear cover 102 through the discharge hole 144.

Then, the refrigerant discharged into the discharge space V2 is then separated from oil within the discharge space V2 or while flowing through the oil separator 185. The refrigerant is then discharged into the refrigeration cycle through the exhaust hole 101*b* while the separated oil is pumped up by the oil pump 136 to circulate to a sliding portion.

Here, the refrigerant and the oil discharged into the discharge space V2 are partially introduced into the back pressure space 124 through the first back pressure hole 147 of the fixed scroll 140 and the second back pressure hole 127 of the frame 102. The introduced refrigerant and oil generates back pressure within the back pressure space 124, thereby supporting the orbiting scroll 150 toward the fixed scroll 140.

In this instance, the back pressure space 124 is sealed by the first sealing portion 191 formed between the frame 102 and the orbiting scroll 150 and the second sealing portion 192 formed between the frame 102 and the rotation shaft 135. Specifically, the second sealing portion 192 reduces a sealing interval t1 between the shaft hole 125 of the frame 102 and the rotation shaft 135. Accordingly, the oil of the back pressure space 124 is introduced through the sealing gap t1 to form an oil layer, thereby sealing the sealing gap t1. Therefore, even when $CO_2$ refrigerant is used, the back pressure space 124 can effectively be sealed and a frictional loss against the rotation shaft 135 at the second sealing portion 192 can be reduced, thereby enhancing efficiency of the compressor.

And, when the oil pocket 125*b* or the reverence seal 125*c* is formed on the second sealing portion 192, the sealing effect can be more enhanced.

A motor-operated compressor according to the present invention may be provided with an intake hole at a side adjacent to a control unit and an exhaust hole at a side adjacent to a fixed scroll constructing a compression unit, on the basis of a driving motor, and a communication passage communicating the driving motor with both side spaces of the driving motor, whereby a refrigerant sucked through the intake hole can be used for cooling the control unit, thereby enhancing cooling efficiency for the control unit.

Elements constructing the control unit are attached on an outer surface of a casing and slits each with a predetermined width are formed around the elements, respectively. Accordingly, upon applying a high pressure refrigerant such as $CO_2$ refrigerant, a deformation of a surface of the casing where the elements are attached into a curved surface can be minimized even though inner pressure of the casing increases, thereby improving coupling force or heat dissipation effect for the elements.

A terminal mounting hole for coupling a terminal may be formed on the casing and a terminal inserted into the terminal mounting hole may be welded or screw-coupled by using a fixing member. This may facilitate a fixing operation of the terminal and allow a mounting portion of the terminal may be made of a light material, thereby reducing a weight of the compressor.

A plurality of protrusions each with a predetermined height may be formed on an outer circumferential surface of a stator along a circumferential direction to be contactable with an inner circumferential surface of the casing. Here, at least part of each of the protrusions may be located within an arcuate length range of each of teeth. This may prevent the slots from opening wide from each other due to stress applied from the casing and concentrated on the stator, thereby preventing frictional loss or collision noise accordingly.

Also, a frame may be provided with a shaft hole through which a rotation shaft is inserted, and a back pressure space communicating with the shaft hole and supporting a rear surface of an orbiting scroll. The back pressure space may induce oil into a sealing gap between the shaft hole and the rotation shaft for sealing. Therefore, a structure for sealing the back pressure space can be simplified and a frictional loss which is caused due to an excessive contact between the rotation shaft and a sealing portion can be reduced even though pressure of the back pressure space is increased upon applying a high pressure refrigerant such as $CO_2$ refrigerant.

What is claimed is:

1. A motor-operated compressor, comprising:

a driving motor including:

a stator;

a coil wound on the stator; and a rotor rotatably disposed within the stator;

a rotation shaft coupled to the rotor;

an orbiting scroll coupled to the rotation shaft, the orbiting scroll being provided to perform an orbiting motion;

a fixed scroll engaged with the orbiting scroll to form compression chambers together with the orbiting scroll, the compression chambers each having a suction chamber, an intermediate pressure chamber and a discharge chamber;

a frame supporting the orbiting scroll, the orbiting scroll being located between the frame and the fixed scroll;

a controller provided to control the driving motor, the driving motor being located between the controller and the frame; and a casing having an inner space in which the driving motor, the orbiting scroll and the fixed scroll are located, the casing including:

an intake hole located at a first portion of the casing adjacent to the controller;

an exhaust hole located at a second portion of the casing adjacent to the fixed scroll, the driving motor being located between the intake hole and the exhaust hole; and a communication passage located between the casing and the stator, whereby a refrigerant introduced into an inner space of the casing through the intake hole is introduced into the suction chamber after passing through the communication passage between the casing and the stator of the driving motor, wherein the stator includes:

a plurality of teeth provided on an inner circumferential surface of the stator;

a plurality of slots located along a circumferential direction of the stator, each slot being located between a pair of adjacent teeth of the plurality of teeth;

a coil wound on each of the plurality of teeth;

a plurality of protrusions provided on an outer circumferential surface of the stator, each protrusion of the plurality of protrusions having a predetermined height to be contactable with an inner circumferential surface of the casing; and a plurality of recesses located along the circumferential direction of the stator, each recess being located between a pair of adjacent protrusions of the plurality of protrusions, wherein each protrusion of the plurality of protrusions is aligned with a corresponding tooth of the plurality of teeth in a radial direction of the stator, wherein each protrusion of the plurality of protrusions is located within an arcuate angular range encompassed by the corresponding tooth of the plurality of teeth, wherein the compressor further comprises an oil pocket provided on an inner circumferential surface of a shaft hole extending through the frame, and wherein the compressor further comprises an oil supply hole provided in the frame to supply oil to the oil pocket, wherein a first end of the oil supply hole branches from at least one back pressure hole provided in each of the fixed scroll and the frame, through which refrigerant and oil discharged from the compression chambers are introduced into a back pressure space, and a second end of the oil supply hole is communicated to the oil pocket.

2. The compressor of claim 1, wherein the casing comprises a housing coupled with the stator, and a cover coupled to an end of the housing closest to the intake hole, the cover provided to seal the inner space of the casing, wherein the controller comprises a plurality of switching elements coupled to an outer side surface of the cover, and wherein a plurality of grooves are provided in the outer side surface of the cover, the grooves having a predetermined depth and width extending along peripheries of the switching elements.

3. The compressor of claim 2, wherein the grooves surround outer circumferences of the switching elements.

4. The compressor of claim 2, wherein the cover is made of a material lighter than a material forming the housing.

5. The compressor of claim 2, further comprising a heat sink provided on an inner side surface of the cover to promote heat exchange between the switching elements and a refrigerant introduced into the inner space of the casing through the intake port, the heat sink comprising a plurality of heat sink fins or a plurality of heat sink recesses.

6. The compressor of claim 2, further comprising:

a terminal mounting hole provided in the cover for coupling a terminal to the cover, at least one end of the terminal being inserted into the terminal mounting hole; and a fixing member for securing the terminal to the cover.

7. The compressor of claim 6, wherein the terminal includes:

a flange located at a first end of the terminal, the flange having an outer diameter greater than an inner diameter of the terminal mounting hole; and a male thread located at a second end of the terminal, wherein the fixing member includes a female thread, and wherein the male thread of the terminal is inserted through the terminal mounting hole and coupled to the female thread of the fixing member located at an outer side surface of the cover, so that the flange is constrained by the inner side surface of the cover at a periphery of the teitninal mounting hole.

8. The compressor of claim 7, further comprising a sealing member located between the flange and the inner side surface of the cover.

9. The compressor of claim 1, further comprising a stress reducing portion provided in a ring shape and provided on the inner circumferential surface of the casing, the stress reducing portion being spaced apart from the outer circumferential surface of the stator, and the stress reducing portion being provided along a portion of an axial extent of the stator within a range in an axial direction of the stator.

10. The compressor of claim 9, wherein the stress reducing portion is provided at a position where an end portion of the stator in the axial direction is accommodated within the casing.

11. The compressor of claim 1, wherein the rotation shaft is inserted into the shaft hole such that an outer circumferential surface of the rotation shaft faces the inner circumferential surface of the shaft hole, wherein one side of the shaft hole faces a rear surface of the orbiting scroll so as to form the back pressure space at the rear surface of the orbiting scroll, and wherein a gap between the inner circumferential surface of the shaft hole and the outer circumferential surface of the rotation shaft is sealed by oil introduced into the back pressure space.

12. The compressor of claim 11, wherein an entire sectional area of the back pressure hole is greater than or equal to an entire sectional area of the gap between the inner circumferential surface of the shaft hole and the outer circumferential surface of the rotation shaft.

13. The compressor of claim 12, further comprising a balance weight located within the back pressure space and coupled to the rotation shaft to be rotatable together with the rotation shaft, wherein an opening of the at least one back pressure hole into the back pressure space is located at a height equal to or lower than a middle height of the balance weight in a direction perpendicular to an axial direction of the driving motor.

14. The compressor of claim 1, wherein a heat sink chamber is provided on an inner side surface of the casing to forcibly induce a refrigerant toward the inner side surface of the casing.

15. The compressor of claim 14, wherein the heat sink chamber includes an inlet and an outlet, and wherein the inlet of the heat sink chamber is provided toward the intake hole, and the outlet of the heat sink chamber is provided toward the inner space of the casing.

16. The compressor of claim 15, wherein the inlet and the outlet of the heat sink chamber are provided on different lines from each other for allowing the refrigerant to evenly circulate the inner space of the heat sink chamber.

17. The compressor of claim 15, wherein the inlet of the heat sink chamber is extended or inclined toward the intake hole.

18. The compressor of claim 14, further comprising a plurality of heat sink fins or a plurality of heat sink recesses provided on the casing within the heat sink chamber.

* * * * *